US010181389B2

(12) United States Patent
Canfield et al.

(10) Patent No.: US 10,181,389 B2
(45) Date of Patent: Jan. 15, 2019

(54) X-RAY TUBE HAVING MAGNETIC QUADRUPOLES FOR FOCUSING AND COLLOCATED STEERING COILS FOR STEERING

(71) Applicant: VAREX IMAGING CORPORATION, Salt Lake City, UT (US)

(72) Inventors: Bradley D. Canfield, Orem, UT (US); Colton B. Woodman, West Valley City, UT (US)

(73) Assignee: VAREX IMAGING CORPORATION, Salt Lake City, UT (US)

( * ) Notice: Subject to any disclaimer, the term of this patent is extended or adjusted under 35 U.S.C. 154(b) by 467 days.

(21) Appl. No.: 14/660,645

(22) Filed: Mar. 17, 2015

(65) Prior Publication Data

US 2015/0187538 A1 Jul. 2, 2015

Related U.S. Application Data

(63) Continuation-in-part of application No. PCT/US2014/063015, filed on Oct. 29, 2014.

(Continued)

(51) Int. Cl.
*H05H 1/10* (2006.01)
*H05G 1/52* (2006.01)

(Continued)

(52) U.S. Cl.
CPC ..... *H01J 35/14* (2013.01); *H01J 35/06* (2013.01); *H01J 35/30* (2013.01); *H01J 35/305* (2013.01); *H05G 1/10* (2013.01); *H05G 1/52* (2013.01)

(58) Field of Classification Search
CPC ..... H01J 35/14; H01J 35/30; H01J 35/305; H01J 35/06; H05G 1/10; H05G 1/52
See application file for complete search history.

(56) References Cited

U.S. PATENT DOCUMENTS 5,703,924 A * 12/1997 Hell ..... H01J 35/06 378/136
5,907,595 A * 5/1999 Sommerer ..... H01J 35/06 378/119

(Continued)

FOREIGN PATENT DOCUMENTS

CN 101896980 A 11/2010
CN 102456528 A 5/2012

(Continued)

OTHER PUBLICATIONS

International Search Report and Written Opinion; PCT/US2014/063015., dated Feb. 3, 2015.

*Primary Examiner* — Chih-Cheng Kao
(74) *Attorney, Agent, or Firm* — Maschoff Brennan

(57) ABSTRACT

An X-ray tube can include: a cathode including an electron emitter that emits an electron beam; an anode configured to receive the electron beam; a first magnetic quadrupole between the cathode and the anode and having a first yoke with four first pole projections extending from the first yoke and oriented toward a central axis of the first yoke and each of the four first pole projections having a first quadrupole electromagnetic coil; a second magnetic quadrupole between the first magnetic quadrupole and the anode and having a second yoke with four second pole projections extending from the second yoke and oriented toward a central axis of the second yoke and each of the four second pole projections having a second quadrupole electromagnetic coil; and at least one steering coil collocated with a quadrupole on a pole projection.

26 Claims, 14 Drawing Sheets

Related U.S. Application Data

(60) Provisional application No. 61/897,181, filed on Oct. 29, 2013.

(51) Int. Cl.

| | |
|---|---|
| ***H01J 35/06*** | (2006.01) |
| ***H01J 35/14*** | (2006.01) |
| ***H01J 35/30*** | (2006.01) |
| ***H05G 1/10*** | (2006.01) |

(56) References Cited

U.S. PATENT DOCUMENTS

| | | | | |
|---|---|---|---|---|
| 6,292,538 | B1 | 9/2001 | Hell et al. | |
| 6,339,635 | B1 | 1/2002 | Schardt et al. | |
| 6,464,551 | B1 | 10/2002 | Lipkin et al. | |
| 7,839,979 | B2 | 11/2010 | Hauttmann et al. | |
| 8,280,007 | B2 | 10/2012 | Rogers et al. | |
| 8,295,442 | B2 | 10/2012 | Caiafa et al. | |
| 8,712,015 | B2 | 4/2014 | Caiafa | |
| 8,946,659 | B2 | 2/2015 | Abs et al. | |
| 9,437,390 | B2 | 9/2016 | Tomita et al. | |
| 2003/0025429 | A1 | 2/2003 | Hell et al. | |
| 2009/0154649 | A1* | 6/2009 | Behling | H01J 35/10 378/137 |
| 2010/0020937 | A1* | 1/2010 | Hautmann | H01J 35/30 378/137 |
| 2010/0195797 | A1 | 8/2010 | Hauttmann | |
| 2010/0207580 | A1 | 8/2010 | Terletska et al. | |
| 2010/0316192 | A1 | 12/2010 | Hauttmann et al. | |
| 2012/0099708 | A1 | 4/2012 | Rogers et al. | |
| 2012/0177185 | A1* | 7/2012 | Koppisetty | H01J 35/14 378/137 |

FOREIGN PATENT DOCUMENTS

| | | | | |
|---|---|---|---|---|
| CN | 103037608 | A | 4/2013 | |
| JP | H07211251 | A | 8/1995 | |
| WO | WO 2008155695 | A1 * | 12/2008 | G21K 1/093 |
| WO | 2012/167822 | A1 | 12/2012 | |
| WO | 2014064748 | A1 | 9/2016 | |

* cited by examiner

X-RAY TUBE HAVING MAGNETIC QUADRUPOLES FOR FOCUSING AND COLLOCATED STEERING COILS FOR STEERING

CROSS-REFERENCE

This patent application is a continuation-in-part application of PCT Patent Application Serial No. PCT/US2014/063015 filed Oct. 29, 2014, which claims priority to U.S. Provisional Application Ser. No. 61/897,181 filed Oct. 29, 2013, which patent applications are incorporated herein by specific reference in their entireties.

BACKGROUND

X-ray tubes are used in a variety of industrial and medical applications. For example, X-ray tubes are employed in medical diagnostic examination, therapeutic radiology, semiconductor fabrication, and material analysis. Regardless of the application, most X-ray tubes operate in a similar fashion. X-rays, which are high frequency electromagnetic radiation, are produced in X-ray tubes by applying an electrical current to a cathode to cause electrons to be emitted from the cathode by thermionic emission. The electrons accelerate towards and then impinge upon an anode. The distance between the cathode and the anode is generally known as A-C spacing or throw distance. When the electrons impinge upon the anode, the electrons can collide with the anode to produce X-rays. The area on the anode in which the electrons collide is generally known as a focal spot.

X-rays can be produced through at least two mechanisms that can occur during the collision of the electrons with the anode. A first X-ray producing mechanism is referred to as X-ray fluorescence or characteristic X-ray generation. X-ray fluorescence occurs when an electron colliding with material of the anode has sufficient energy to knock an orbital electron of the anode out of an inner electron shell. Other electrons of the anode in outer electron shells fill the vacancy left in the inner electron shell. As a result of the electron of the anode moving from the outer electron shell to the inner electron shell, X-rays of a particular frequency are produced. A second X-ray producing mechanism is referred to as Bremsstrahlung. In Bremsstrahlung, electrons emitted from the cathode decelerate when deflected by nuclei of the anode. The decelerating electrons lose kinetic energy and thereby produce X-rays. The X-rays produced in Bremsstrahlung have a spectrum of frequencies. The X-rays produced through either Bremsstrahlung or X-ray fluorescence may then exit the X-ray tube to be utilized in one or more of the above-mentioned applications.

In certain applications, it may be beneficial to lengthen the throw length of an X-ray tube. The throw length is the distance from cathode electron emitter to the anode surface. For example, a long throw length may result in decreased back ion bombardment and evaporation of anode materials back onto the cathode. While X-ray tubes with long throw lengths may be beneficial in certain applications, a long throw length can also present difficulties. For example, as a throw length is lengthened, the electrons that accelerate towards an anode through the throw length tend to become less laminar resulting in an unacceptable focal spot on the anode. Also affected is the ability to properly focus and/or position the electron beam towards the anode target, again resulting in a less than desirable focal spot—either in terms of size, shape and/or position. When a focal spot size or location is unacceptable, it may be difficult to produce useful X-ray images.

The subject matter claimed herein is not limited to embodiments that solve any disadvantages or that operate only in environments such as those described above. Rather, this background is only provided to illustrate one exemplary technology area where some embodiments described herein may be practiced.

SUMMARY

Disclosed embodiments address these and other problems by improving X-ray image quality via improved electron emission characteristics, and/or by providing improved control of a focal spot size and position on an anode target. This helps to increase spatial resolution or to reduce artifacts in resulting images.

In one embodiment, an X-ray tube can include: a cathode including an electron emitter that emits an electron beam; an anode configured to receive the emitted electrons of the electron beam; a first magnetic quadrupole between the cathode and the anode and having a first quadrupole yoke with four evenly distributed first quadrupole pole projections extending from the first quadrupole yoke and oriented toward a central axis of the first quadrupole yoke and each of the four first quadrupole pole projections having a first quadrupole electromagnetic coil; a second magnetic quadrupole between the first magnetic quadrupole and the anode and having a second quadrupole yoke with four evenly distributed second quadrupole pole projections extending from the second quadrupole yoke and oriented toward a central axis of the second quadrupole yoke and each of the four second quadrupole pole projections having a second quadrupole electromagnetic coil; and two opposing pole projections of the first or second quadrupole pole projections having electromagnetic steering coils formed thereof. That is, the steering coils are collocated on the same pole projections that include quadrupole coils. The steering coils produce an offset quadrupole field by one steering coil or a pair of steering coils having an AC offset that perturbs the quadrupole field that is generated by the quadrupole electromagnetic coils, which shifts the center of the quadrupole field from a central axis (e.g., electron beam axis, center of cores, center of X-ray tube, etc.). The shifted quadrupole field steers the electron beam passing therethrough. The electromagnetic steering coils can be formed adjacent to quadrupole electromagnetic coils of the first or second quadrupole electromagnetic coils. In one aspect, the X-ray tube can include one steering coil, one pair of steering coils, three steering coils, or two pairs of steering coils. Each of the pairs of steering coils having steering coils on opposing pole projections of the first and/or second quadrupole pole projections. Accordingly, a first single steering coil or first pair of steering coils can shift the quadrupole field in a first direction, and a second single coil or second pair of steering coils can shift the quadrupole in a second direction that is orthogonal with the first direction.

In one embodiment, a method of focusing and steering an electron beam in an X-ray tube can include: providing an X-ray tube of one of the embodiments (e.g., having at least one steering coil or one pair of steering coils on opposing quadrupole pole projections); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating at least one steering coil or the pair of steering coils to steer the electron beam away from the center of the quadrupole cores or away from the natural electron beam axis (e.g., without steering) that is aligned with the center axis of the X-ray tube. In one aspect, the method can include operating at least one coil of opposing steering coils to have different currents to form an asymmetric quadrupole moment. That is, each steering coil of a pair can be operated at different currents to form and move an asymmetric quadrupole field in one direction. Also, each steering coil of each pair (e.g., all four steering coils) can be operated at different currents to form and move an asymmetric quadrupole field in two orthogonal directions. Operating one or two pairs of steering coils can shift the quadrupole field off axis to steer the electron beam. However, only one steering coil of each pair needs to be provided with AC offset for steering the electron beam. Activating one coil with AC offset can be considered to be operating the pair of opposing coils that has that one coil with AC offset because the other coil of the pair can have zero AC offset.

In one embodiment, a method of focusing and steering an electron beam in an X-ray tube can include: providing the X-ray tube of one of the embodiments (e.g., having at least two pairs of steering coils on two pairs of quadrupole pole projections); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating at least one coil of a first pair of steering coils on an opposing pair of quadrupole pole projections to steer the electron beam away from the electron beam axis in a first direction; and operating at least one coil of a second pair of steering coils on a pair of opposing quadrupole pole projections to steer the electron beam away from the electron beam axis in a second direction that is orthogonal to the first direction. In one aspect, the method can include operating opposing steering coils to have different powers to form a first asymmetric quadrupole moment. In one aspect, the method can include operating two pair of opposing steering coils so that each steering coil (e.g., all four steering coils) has a different current from the other coils so as to form a first asymmetric quadrupole moment. In one aspect, the method can include operating opposing steering coils of a second pair of steering coils to have different currents to form a second asymmetric quadrupole moment.

Certain embodiments include a magnetic system implemented as two magnetic quadrupoles and two steering coils or two pairs of steering coils disposed in the electron beam path of an x-ray tube. The two magnetic quadrupoles are configured to focus the electron beam path in both directions perpendicular to the beam path. The two steering coils or two pairs of steering coils are collocated on pole projections one of the quadrupole cores with quadrupole coils to steer the beam in both directions perpendicular to the beam path. That is, each steering coil is collocated with a quadrupole coil on a pole projection. The two quadrupoles form a magnetic lens (sometimes referred to as a "doublet") and the focusing is accomplished as the beam passes through the quadrupole lens. The steering is accomplished by the two steering coils or two pairs of steering coils which are created by steering coils wound on opposing quadrupole core pole protrusions along with the quadrupole coils that are wound on the same pole projections to maintain the focusing coil current, which results in an overall shift in the quadrupole magnetic field. Steering of the beam occurs through appropriate steering coil energizing, and can be done in one axis or a combination of orthogonal axes with orthogonal steering coil pairs. In one embodiment, one quadrupole is used to focus in the first direction and the second quadrupole to focus in the second direction with collocated steering coils to steer in both directions. The two quadrupoles together form the quadrupole lens.

In sum, proposed embodiments provide any emitters (e.g., a flat emitter with tunable emission capabilities) that emit substantially laminar beams as an electron source. The embodiments utilize two quadrupoles to focus the beam in two dimensions to a multiplicity of focal spot sizes, and one of the quadrupoles having a steering coil for each steering direction or one or two pairs of steering coils collocated on pole projections with quadrupole coils that can steer the beam to a multiplicity of focal spot positions for enhanced imaging performance. It is noted that the steering coils can function as electron beam deflecting coils or electron beam steering coils. This also provides for creating a multiplicity of focal spot sizes and positions from a single emitter; the focal spot size and/or location conceivably could be changed during an exam as well, which allows for the focal spot to be changed (e.g., focused and positioned) on the fly.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

FIG. 6B shows a focused quadrupole field that is shifted in the x-direction, and FIG. 6C shows a focused quadrupole shifted in the y-direction.

DETAILED DESCRIPTION

Figure 1A:
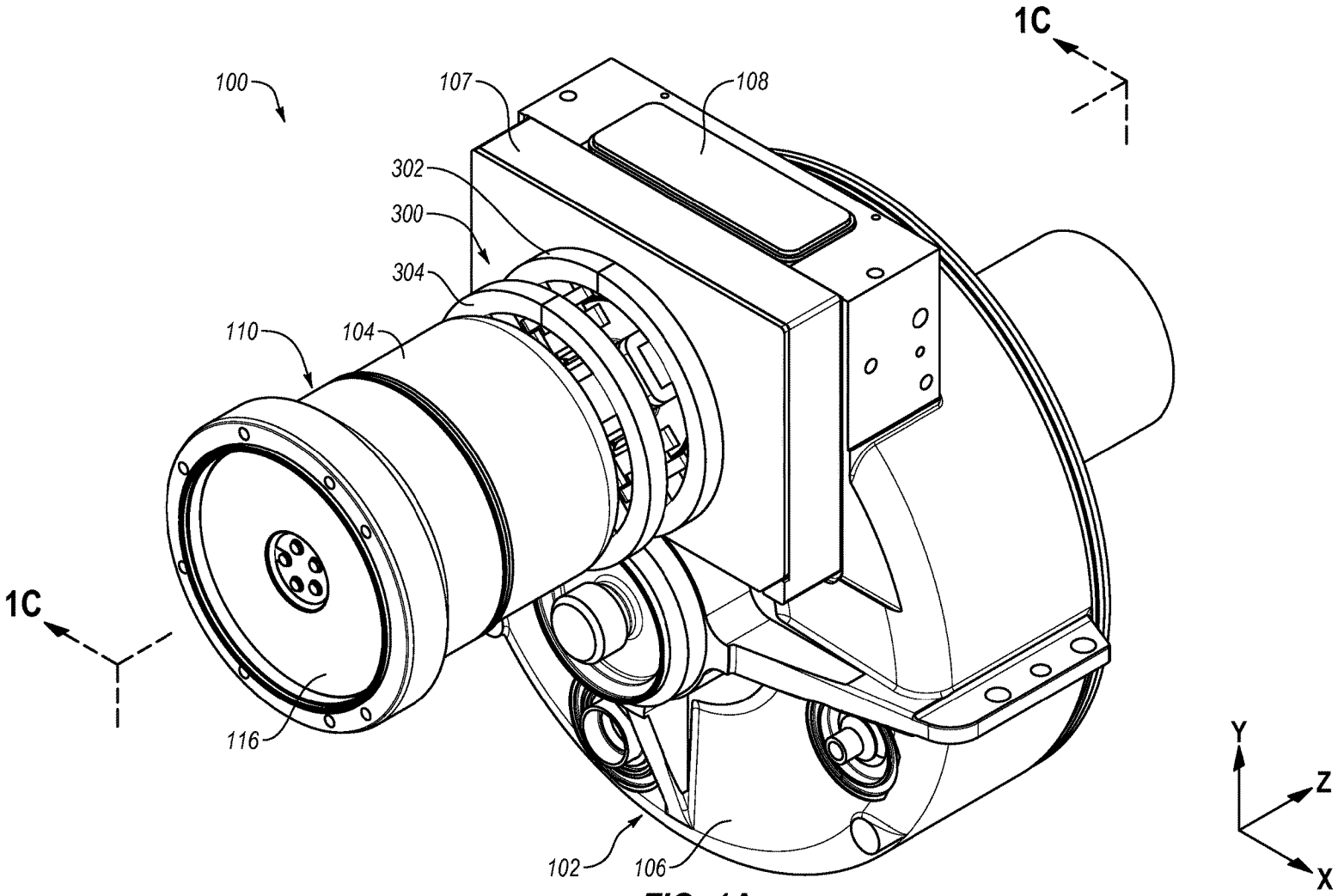
FIG. 1A is a perspective view of an example X-ray tube in which one or more embodiments described herein may be implemented.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. General Overview of an Exemplary X-Ray Tube

Embodiments of the present technology are directed to X-ray tubes of the type having a vacuum housing in which a cathode and an anode are arranged. The cathode includes an electron emitter that emits electrons in the form of an electron beam that is substantially perpendicular to a face of the emitter, and the electrons are accelerated due to a voltage difference between the cathode and the anode so as to strike a target surface on the anode in an electron region referred to as a focal spot. Embodiments can also include an electron beam focusing and/or steering component that is configured to manipulate the electron beam by: (1) deflecting, or steering, the electron beam, and thereby altering the position of the focal spot on the anode target; and/or (2) focusing the electron beam so as to alter the dimensions of the focal spot. Different embodiments utilize different configurations of such focusing and/or steering components, such as magnetic systems, including combinations of electromagnets formed as quadrupoles and separate steering magnetic fields via steering coil elements with current flowing therein and disposed on a carrier/yoke comprised of a suitable material.

The embodiments can include an electron beam focusing component that includes two quadrupole magnetic cores. Generally, each quadrupole magnetic core can have a yoke with four pole projections evenly distributed therearound, and each pole projection can include an electromagnetic quadrupole coil so that all four electromagnets provide a magnetic quadrupole moment. One quadrupole core can narrow the electron beam in the length direction, and the other quadrupole core can narrow the electron beam in the width direction. Thereby, the combination of the two quadrupole cores can cooperate to focus the electron beam, which allows precise length and width dimension control of the focal spot on the anode. However, either or both quadrupole cores can focus in the length and width directions. The quadrupoles can include quadrupole coils that have constant current to achieve the focusing effect. Also, a pulse width modulated circuit coupled with the coils can create constant current in the coils because the coils are current integrating devices. For example, a current pulse train into the coil can cause the coil to create a constant current in the coil, which can be changed by changing the current pulse train. Also a DC power supply can provide constant current (e.g., DC current).

The embodiments can include an electron beam steering component that includes one of the magnetic quadrupole cores having at least one steering coil, or a pair or two orthogonal pairs of steering coils collocated on the pole projections with quadrupole coils. Each pair of steering coils can be included on a pair of oppositely disposed pole projections and collocated with electromagnetic quadrupole coils. The steering system can be configured to operate each steering coil separately to shift the quadrupole magnetic field in order to move the electron beam on the focal spot on the anode target surface. In one aspect, the quadrupole core closest to the anode (e.g., anode quadrupole core) can have a yoke with four pole projections evenly distributed therearound that each have a quadrupole electromagnetic coil and a steering coil with independent current control. Accordingly, the anode quadrupole core can have quadrupole and steering coils wound around the pole projections on the yoke. The anode quadrupole core can steer the electron beam in any direction or toward any quadrant relative to the electron beam axis by independently operating the different steering coils. The steering coils can modulate the quadrupole magnetic field that nudges and deflects the electron beam, and then the electron beam coasts to the target anode. However, the quadrupole core closest to the cathode (e.g., cathode quadrupole core) can be configured for focusing with quadrupole coils and steering with steering coils, while the anode quadrupole core only focuses with quadrupole coils. In an alternative configuration, the cathode quadrupole core can focus and steer in a first direction, and the anode quadrupole core can focus and steer in a second direction that is perpendicular to the first direction, whereby the combination of both cores can be configured in such a manner to steer the electron beam in any direction desired. One example of an X-ray tube having certain of these features—discussed in further detail below—is shown in FIGS. 1A-1D.

Steering can be accomplished by moving the center of the quadrupole field away from a central axis, where the central axis can be the natural (e.g., unperturbed) electron beam axis or aligned central axis of the quadrupole cores or central axis of the X-ray tube. Introducing an AC offset to at least one of the steering coils of the quadrupole cores can provide the shift of the quadrupole field. This may be an asymmetric quadrupole field that has focusing that is focused off the central axis. The quadrupole field can be shifted off axis from the central axis or off the central axes of the cores. The quadrupole still provides focusing with the center being shifted off axis, and the electron beam follows the center of the shifted quadrupole field. While the constant focusing current in the quadrupole coils provides focusing, the AC offset in at least one steering coil can shift the center of the quadrupole field away from center of the quadrupole cores. The shifted quadrupole field is similar to a dipole effect being superimposed over a quadrupole field. The AC offset to each coil of a core can be independent and different to perform the steering of the electron beam. The AC offset can be time vary steering current.

In one embodiment, the X-ray-tube can be included in an X-ray system, such as a CT system, and can include electron beam control. The X-ray tube can have high power with focusing and 2-dimensional beam movement controllability with a short or a long throw between the cathode and anode. The X-ray tube can control the beam to a defined emission area for the beam or focal spot area or shape or location on the anode. The X-ray tube can focus the electron beam in two dimensions under active beam manipulation by a cathode quadrupole and anode quadrupole. The X-ray tube can steer the electron beam in two dimensions under active beam manipulation by an anode quadrupole core having independent steering coils on the pole projections with quadrupole coils, where the steering coils are configured with independent current control so as to shift or steer the electron beam in one direction or two orthogonal directions. The steering coils shift the quadrupole field to implement steering. Each of the steering coils can have independent coil current control, which is used to perturb the anode quadrupole field. This facilitates shifting the quadrupole magnetic field, which will in turn steer the electron beam passing through the anode quadrupole field. Such beam steering can be implemented in imaging methods to provide a richer CT data set, where the rich CT data set can be used to improve resolution of an image from the CT. The improved resolution can improve resolution in the slice and row directions of the CT, for example, as per being received (e.g., seen) by the detector. Beam steering can be useful to implement data oversampling of the X-ray by allowing for multiple focal spot locations for a given X-ray imaging time duration. In one aspect, the anode quadrupole core can be configured only for focusing, while the cathode quadrupole core can be for focusing and/or steering.

In one embodiment, the cathode emits an electron beam that flows from the cathode toward the anode such that the beam spreads the electrons apart during transit, and one or more of the quadrupole cores focus the electron beam to a defined focal spot. In one aspect, both quadrupole cores provide a focusing effect on the electron beam. This allows for both beam width (e.g., X axis) and beam length (e.g., Y axis) focusing, wherein one quadrupole core focuses in the length and the other quadrupole core focuses in the width. This also allows for the ability of the X-ray tube to create a plurality of different types of focal spot sizes and shapes from a single emitter, where such changes of focusing and change of beam length and/or width can be performed during imaging, such as during a CT examination. However, movement of the X-ray in the Z axis may be desirable, and due to the angle of the anode target surface, steering of the electron beam in the Y axis can cause the X-ray to move in the Z axis.

In one embodiment, the X-ray tube can perform beam focusing with high magnetic flux in a small throw volume or space. The magnetic material suitable for high magnetic flux can be a material that does not saturate and can be used for the quadrupole cores in the yokes, such as the yokes for two adjacent quadrupole cores. Also, the quadrupole pole projections can be the same material as the yoke. Such a material can be iron.

In one embodiment, the quadrupole core configured for focusing and steering can include a magnetic material that has high dynamic response, which material can be used for the yoke and pole projections. The material can have less magnetic flux than the material of the quadrupole core that is configured for only focusing. The material of the steering quadrupole core can be configured so that it does not saturate at low levels, and it responds several orders of magnitude faster than the iron material used for the focusing-only quadrupole cores. The steering quadrupole core material can be iron based ferrite with lower saturation flux levels, which allows for high magnetic switching speeds. However, the ferrite material allows for the quadrupole core to respond to flux changes much faster compared to iron, which is beneficial for switching magnetic fields, such as in steering. The material allows up to 7 kHz switching and as low as about 20 microseconds transitions. In one aspect, the steering quadrupole core material can be a ferrite material. The ferrite can be an iron ceramic, such as iron oxide, which can have different magnetic characteristics compared to the focusing-only quadrupole core material.

In one embodiment, the X-ray can include 0 degrees on an axis, and the two quadrupole cores having yokes with the pole projections and the quadrupole electromagnets aligned, which can be referenced at 45, 135, 225 and 315 degrees. The steering coils can be collocated on the pole projections with the quadrupole coils.

In one embodiment, the pole faces of the pole projections can have a reduced profile, such as from ¼ to ⅜ inches across. This can include the pole faces of any of the pole projections, such as for the focusing or steering quadrupole cores.

In one embodiment, a steering quadrupole core can have steering coils on the quadrupole pole projections that each have their own supply line for power and operation, which can be independently controlled.

In one embodiment, the cores each can include fluidic pathways fluidly coupled to a coolant system, which allows coolant to flow through the yokes, and optionally through the pole projections. As such, each pole projection can have a fluid inlet pathway and a fluid outlet pathway coupled to a fluid pathway in the yoke.

Figure 1B:
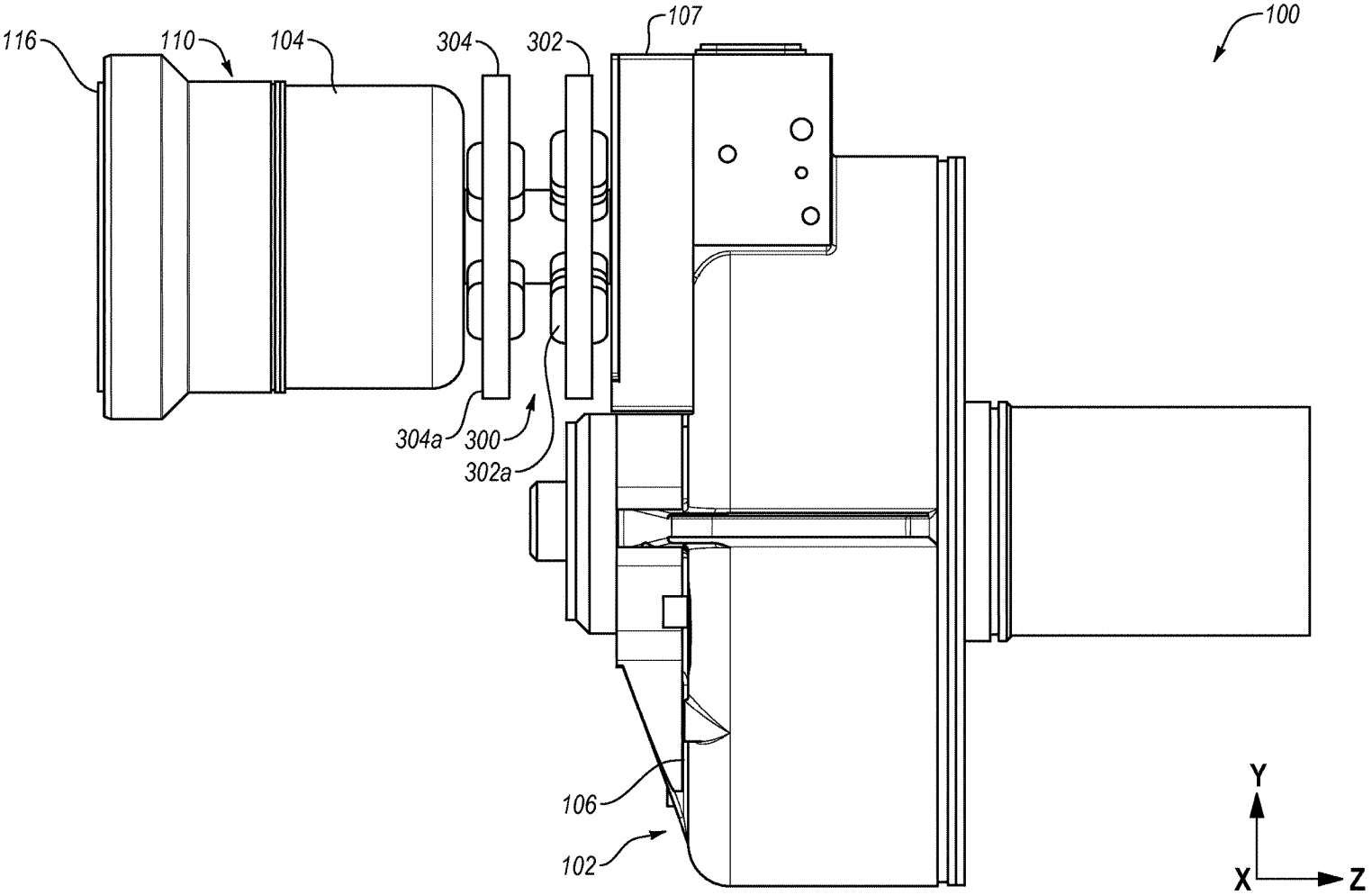
FIG. 1B is a side view of the X-ray tube of FIG. 1A.
Figure 1C:
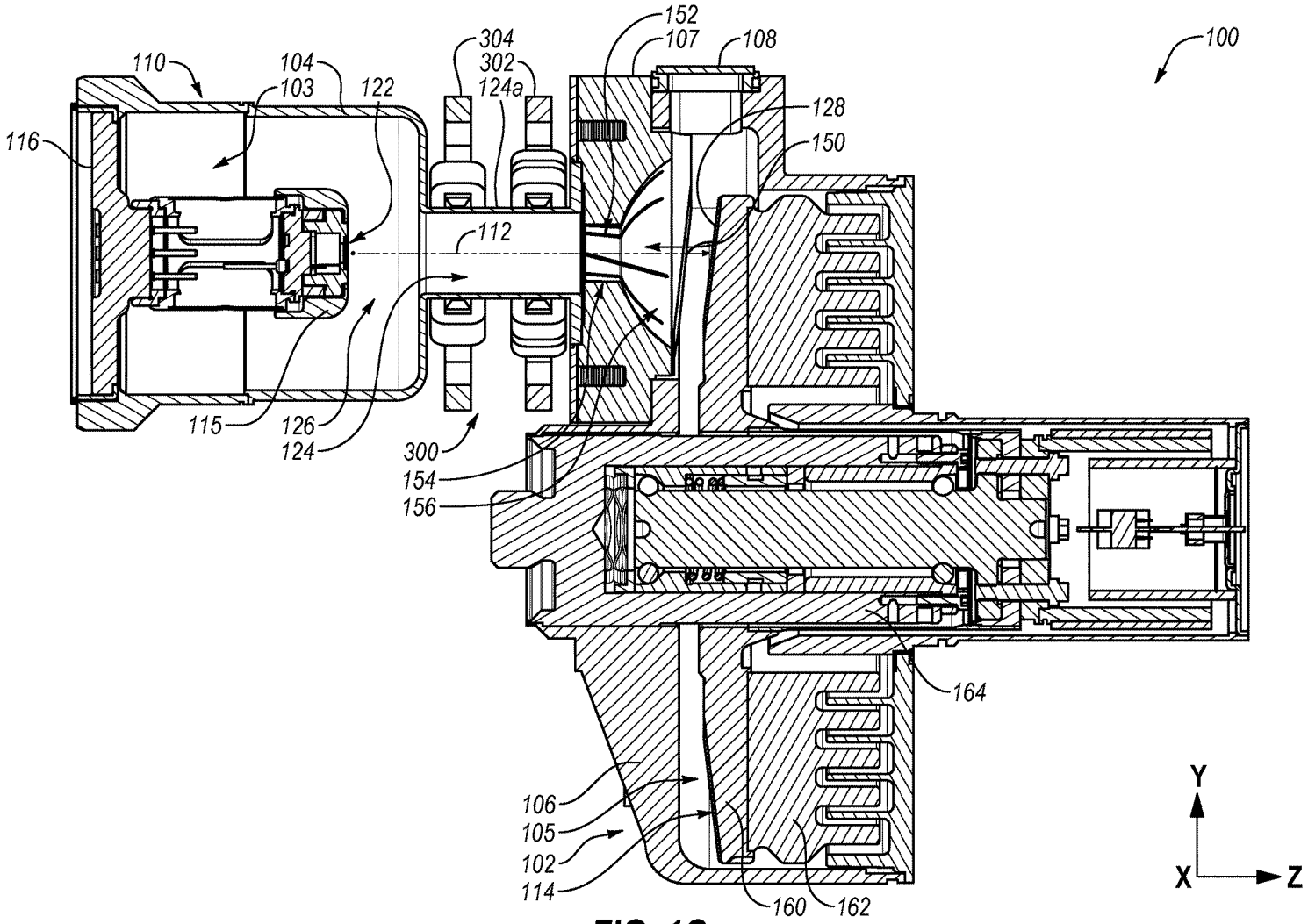
FIG. 1C is a cross-sectional view of the X-ray tube of FIG. 1A.

FIGS. 1A-1C are views of one example of an X-ray tube 100 in which one or more embodiments described herein may be implemented. Specifically, FIG. 1A depicts a perspective view of the X-ray tube 100 and FIG. 1B depicts a side view of the X-ray tube 100, while FIG. 1C depicts a cross-sectional view of the X-ray tube 100. The X-ray tube 100 illustrated in FIGS. 1A-1C represents an example operating environment and is not meant to limit the embodiments described herein.

Generally, X-rays are generated within the X-ray tube 100, some of which then exit the X-ray tube 100 to be utilized in one or more applications. The X-ray tube 100 may include a vacuum enclosure structure 102 which may act as the outer structure of the X-ray tube 100. The vacuum structure 102 may include a cathode housing 104 and an anode housing 106. The cathode housing 104 may be secured to the anode housing 106 such that an interior cathode volume 103 is defined by the cathode housing 104, and an interior anode volume 105 is defined by the anode housing 106, each of which are joined so as to define the vacuum enclosure 102.

In some embodiments, the vacuum enclosure 102 is disposed within an outer housing (not shown) within which a coolant, such as liquid or air, is circulated so as to dissipate heat from the external surfaces of the vacuum enclosure 102. An external heat exchanger (not shown) is operatively connected so as to remove heat from the coolant and recirculate it within the outer housing.

The X-ray tube 100 depicted in FIGS. 1A-1C includes a shield component (sometimes referred to as an electron shield, aperture, or electron collector) 107 that is positioned between the anode housing 106 and the cathode housing 104 so as to further define the vacuum enclosure 102. The cathode housing 104 and the anode housing 106 may each be welded, brazed, or otherwise mechanically coupled to the shield 107. While other configurations can be used, examples of suitable shield implementations are further described in U.S. patent application Ser. No. 13/328,861 filed Dec. 16, 2011 and entitled "X-ray Tube Aperture Having Expansion Joints," and U.S. Pat. No. 7,289,603 entitled "Shield Structure And Focal Spot Control Assembly For X-ray Device," the contents of each of which are incorporated herein by reference for all purposes.

The X-ray tube 100 may also include an X-ray transmissive window 108. Some of the X-rays that are generated in the X-ray tube 100 may exit through the window 108. The window 108 may be composed of beryllium or another suitable X-ray transmissive material.

With specific reference to FIG. 1C, the cathode housing 104 forms a portion of the X-ray tube 100 referred to as a cathode assembly 110. The cathode assembly 110 generally includes components that relate to the generation of electrons that together form an electron beam, denoted at 112. The cathode assembly 110 may also include the components of the X-ray tube 100 between an end 116 of the cathode housing 104 and an anode 114. For example, the cathode assembly 110 may include a cathode head 115 having an electron emitter, generally denoted at 122, disposed at an end of the cathode head 115. As will be further described, in disclosed embodiments the electron emitter 122 can be configured as a planar electron emitter. When an electrical current is applied to the electron emitter 122, the electron emitter 122 is configured to emit electrons via thermionic emission, that together form a laminar electron beam 112 that accelerates towards the anode target 128.

The cathode assembly 110 may additionally include an acceleration region 126 further defined by the cathode housing 104 and adjacent to the electron emitter 122. The electrons emitted by the electron emitter 122 form an electron beam 112 and traverse through the acceleration region 126 and accelerate towards the anode 114 due to a suitable voltage differential. More specifically, according to the arbitrarily-defined coordinate system included in FIGS. 1A-1C, the electron beam 112 may accelerate in a z-direction, away from the electron emitter 122 in a direction through the acceleration region 126.

The cathode assembly 110 may additionally include at least part of a drift region 124 defined by a neck portion 124*a* of the cathode housing 104. In this and other embodiments, the drift region 124 may also be in communication with an aperture 150 provided by the shield 107, thereby allowing the electron beam 112 emitted by the electron emitter 122 to propagate through the acceleration region 126, the drift region 124 and aperture 150 until striking the anode target surface 128. In the drift region 124, a rate of acceleration of the electron beam 112 may be reduced from the rate of acceleration in the acceleration region 126. As used herein, the term "drift" describes the propagation of the electrons in the form of the electron beam 112 through the drift region 124.

Positioned within the anode interior volume 105 defined by the anode housing 106 is the anode 114. The anode 114 is spaced apart from and opposite to the cathode assembly 110 at a terminal end of the drift region 124. Generally, the anode 114 may be at least partially composed of a thermally conductive material or substrate, denoted at 160. For example, the conductive material may include tungsten or molybdenum alloy. The backside of the anode substrate 160 may include additional thermally conductive material, such as a graphite backing, denoted by way of example here at 162.

The anode 114 may be configured to rotate via a rotatably mounted shaft, denoted here as 164, which rotates via an inductively induced rotational force on a rotor assembly via ball bearings, liquid metal bearings or other suitable structure. As the electron beam 112 is emitted from the electron emitter 122, electrons impinge upon a target surface 128 of the anode 114. The target surface 128 is shaped as a ring around the rotating anode 114. The location in which the electron beam 112 impinges on the target surface 128 is known as a focal spot (not shown). Some additional details of the focal spot are discussed below. The target surface 128 may be composed of tungsten or a similar material having a high atomic ("high Z") number. A material with a high atomic number may be used for the target surface 128 so that the material will correspondingly include electrons in "high" electron shells that may interact with the impinging electrons to generate X-rays in a manner that is well known.

During operation of the X-ray tube 100, the anode 114 and the electron emitter 122 are connected in an electrical circuit. The electrical circuit allows the application of a high voltage potential between the anode 114 and the electron emitter 122. Additionally, the electron emitter 122 is connected to a power source such that an electrical current is passed through the electron emitter 122 to cause electrons to be generated by thermionic emission. The application of a high voltage differential between the anode 114 and the electron emitter 122 causes the emitted electrons to form an electron beam 112 that accelerates through the acceleration region 126 and the drift region 124 towards the target surface 128. Specifically, the high voltage differential causes the electron beam 112 to accelerate through the acceleration region 126 and then drift through the drift region 124. As the electrons within the electron beam 112 accelerate, the electron beam 112 gains kinetic energy. Upon striking the target surface 128, some of this kinetic energy is converted into electromagnetic radiation having a high frequency, i.e., X-rays. The target surface 128 is oriented with respect to the window 108 such that the X-rays are directed towards the window 108. At least some portion of the X-rays then exit the X-ray tube 100 via the window 108.

Additionally, FIG. 1C shows a cross-sectional view of an embodiment of a cathode assembly 110 that can be used in the X-ray tube 100 with the planar electron emitter 122 and magnetic system 300 described herein. As illustrated, a throw path between the electron emitter 122 and target surface 128 of the anode 114 can include the acceleration region 126, drift region 124, and aperture 150 formed in shield 107. In the illustrated embodiment, the aperture 150 is formed via aperture neck 154 and an expanded electron collection surface 156 that is oriented towards the anode 114.

Optionally, one or more electron beam manipulation components of the magnetic system 300 can be provided. Such devices can be implemented so as to "steer" and/or "deflect" the electron beam 112 as it traverses the drift region 124, thereby manipulating or "toggling" the position of the focal spot on the target surface 128. Additionally or alternatively, a manipulation component can be used to alter or "focus" the cross-sectional shape of the electron beam and thereby change the shape of the focal spot on the target surface 128. In the illustrated embodiments electron beam focusing and steering are provided by way of a magnetic system denoted generally at 300.

The magnetic system 300 can include various combinations of focusing quadrupole and steering coil implementations that are disposed so as to impose magnetic forces on the electron beam 112 so as to focus and/or steer the beam. One example of the magnetic system 300 is shown in FIGS. 1A-1D. In this embodiment, the magnetic system 300 is implemented as two magnetic cores 302, 304 disposed in the electron beam path 112 of the X-ray tube 100. The combination of the two magnetic cores 302, 304 are configured to (a) focus in both directions perpendicular to the beam path, and (b) to steer the beam in both directions perpendicular to the beam path. In this way, the two cores 302, 304 act together to form a magnetic lens (sometimes referred to as a "doublet"), and the focusing and steering is accomplished as the electron beam passes through the quadrupole "lens." The "focusing" provides a desired focal spot shape and size, and the "steering" affects the positioning of the focal spot on the anode target surface 128. Each quadrupole is implemented with a core section, or a yoke, denoted as a cathode yoke at 304*a*, and an anode yoke at 302*a*.

Figure 2A:
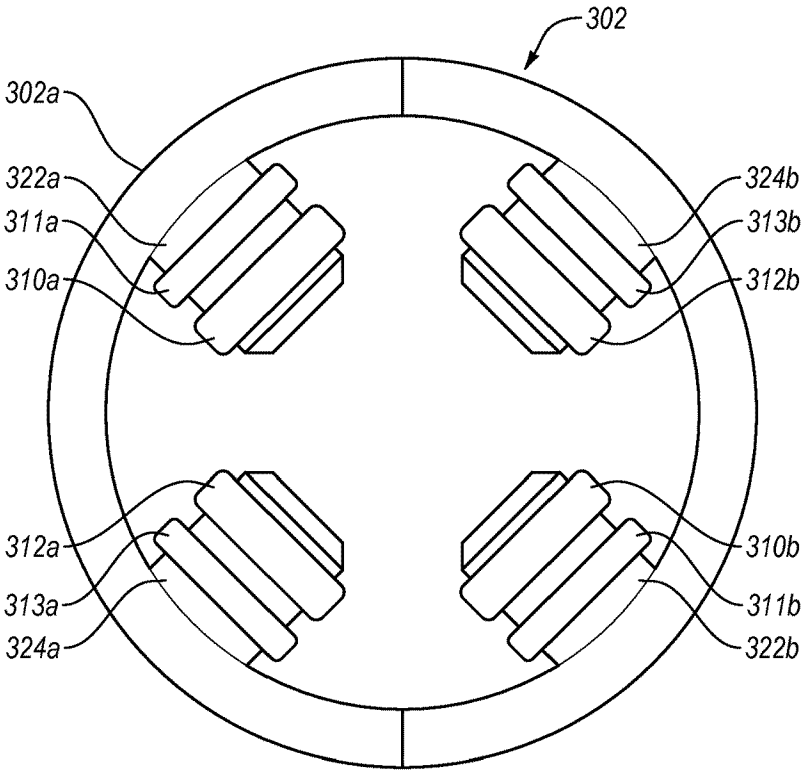
FIG. 2A shows an embodiment of an anode core.
Figure 2B:
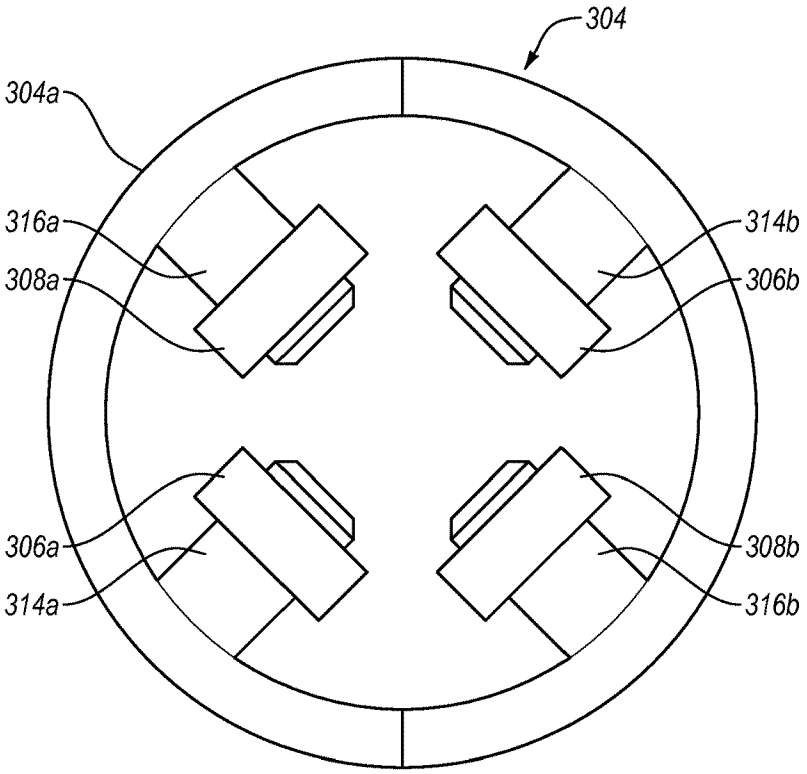
FIG. 2B shows an embodiment of a cathode core.

FIG. 2A shows an embodiment of an anode core 302 (e.g., closer to anode) having an anode yoke 302*a*, and FIG. 2B shows an embodiment of a cathode core 304 (e.g., closer to cathode) having a cathode yoke 304*a*. Each yoke 302*a*, 304*a* includes four pole projections arranged in an evenly distributed and opposing relationship, cathode pole projections 314*a,b* (e.g., first cathode pole projections) and 316*a,b* (e.g., second cathode pole projections) on the cathode yoke 304*a*, and anode pole projections 322*a,b* (e.g., first anode pole projections) and 324*a,b* (e.g., second anode pole projections) on the anode yoke 302*a*. Each pole projection includes corresponding quadrupole electromagnetic coils, denoted as cathode quadrupole coils 306*a,b* (e.g., first cathode coils) and 308*a,b* (e.g., second cathode coils) on the cathode yoke 304*a* and anode quadrupole coils 310*a,b* (e.g., first anode coils) and 312*a,b* (e.g., second anode coils) on the anode yoke 302*a*. Additionally, the pole projections 322*a,b* and 324*a,b* of the anode yoke 302*a* includes steering coils 311*a,b* and 313*a,b*. Current is supplied to the quadrupole coils so as to provide the desired magnetic focusing effect, and current is supplied to the steering coils so as to provide the desired steering effect, as will be described in further detail below. The steering coils can also be referred to as field shifting coils because these coils are operated independently to shift the quadrupole field and thereby steer the electron beam, which creates the focal spot. This allows the position of the focal spot to be moved on the anode target.

Figure 1D:
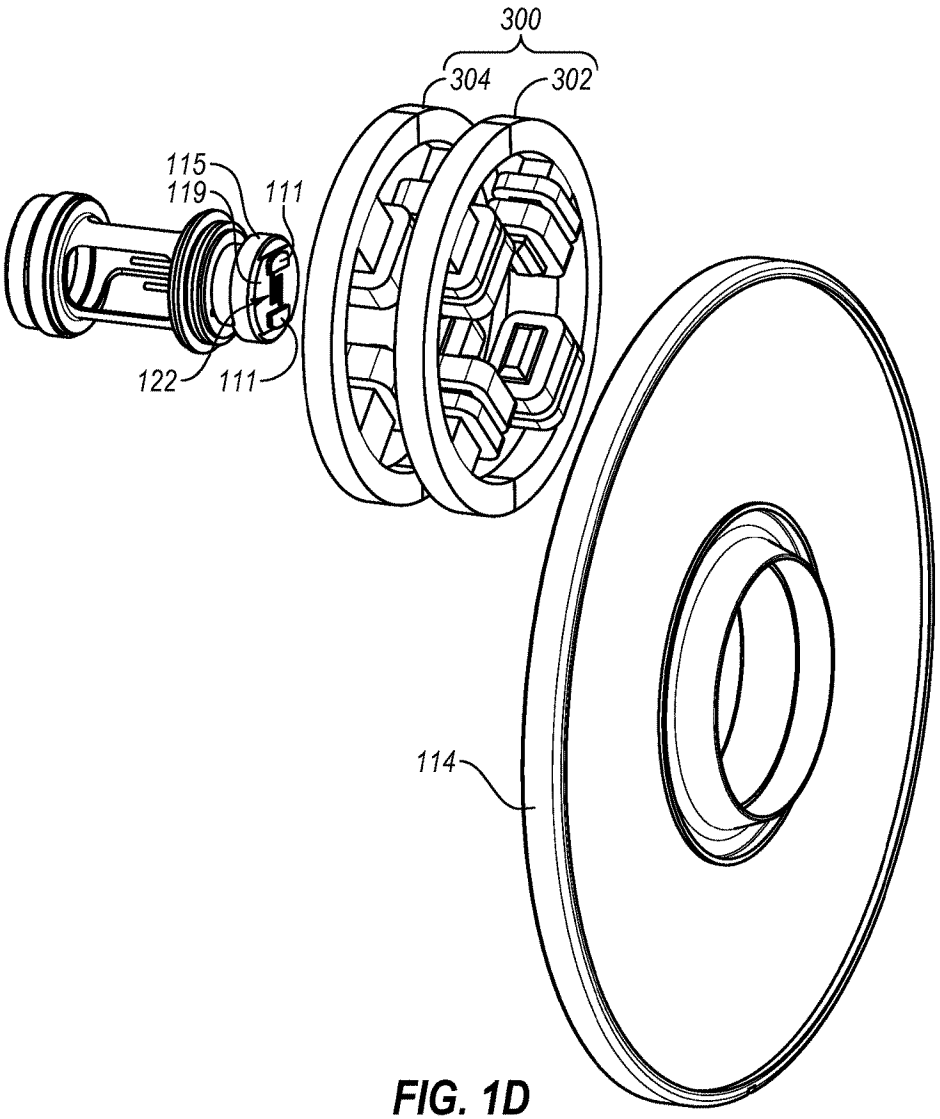
FIG. 1D is a perspective view of internal components of the X-ray tube of FIG. 1A.

FIG. 1D shows the components of the X-ray device 100 that are arranged for electron emission, electron beam steering and/or focusing, and X-ray emission. In FIG. 1D, disposed within the beam path is the magnetic system 300 configured to focus and steer the electron beam before reaching the anode 114, as noted above. A portion of the cathode assembly 110 has the cathode head 115 with the electron emitter 122 on an end of the cathode head 115 so as to be oriented or pointed toward the anode 114 (see FIG. 1C for orientation). The cathode head 115 can include a head surface 119 that has an emitter region that is formed as a recess that is configured to receive the electron emitter 122 (e.g., planar electron emitter). The head surface 119 also includes electron beam focusing elements 111 located on opposite sides of the electron emitter 122.

In one embodiment, the electron emitter 122 can be comprised of a tungsten foil, although other materials can be used. Alloys of tungsten and other tungsten variants can be used. Also, the emitting surface can be coated with a composition that reduces the emission temperature. For example, the coating can be tungsten, tungsten alloys, thoriated tungsten, doped tungsten (e.g., potassium doped), zirconium carbide mixtures, barium mixtures or other coatings can be used to decrease the emission temperature. Any known emitter material or emitter coating, such as those that reduce emission temperature, can be used for the emitter material or coating. Examples of suitable materials are described in U.S. Pat. No. 7,795,792 entitled "Cathode Structures for X-ray Tubes," which is incorporated herein in its entirety by specific reference.

II. Example Embodiments of a Magnetic System Providing Electron Beam Focusing and Two-Axis Beam Steering Via Two Quadrupoles and Two Steering Coils Collocated on Pole Protrusions with Quadrupole Coils As noted above, certain embodiments include an electron beam manipulation component that allows for steering and/or focusing of the electron beam so as to control the position and/or size and shape of the focal spot on the anode target. In one embodiment, this manipulation is provided by way of a magnetic system implemented as two magnetic quadrupoles and at least one pair of steering coils disposed in the electron beam path. For example, in one embodiment, two quadrupoles are used to provide focusing of the electron beam, and at least one pair of steering coils is used to provide steering of the electron beam. In this approach, focusing magnetic fields can be provided by both quadrupoles (e.g., the anode side quadrupole and the cathode side quadrupole) and the electron beam steering magnetic fields can be provided by one or two pair of steering coils. Alternatively, magnetic fields for steering can be done for one direction with one pair of steering coils and for the other direction with the other pair of shifting coils, where the pairs are orthogonal with each other. Also, only one steering coil of a steering coil pair needs to receive AC offset in order to implement the steering function. As such, embodiments may only include one steering coil for each steering coil that is shown, thereby one steering coil of each steering coil pair can be omitted.

In one embodiment, the steering is accomplished by the two pairs of steering coils which are created by steering coils wound on one of the core's poles projections adjacent with quadrupole coils, where the quadrupole coils (e.g., wound on the same pole projections as the steering coils) maintain the constant focusing coil current. Steering of the electron beam (and resulting shifting of the focal spot) occurs through appropriate steering coil pair energizing and can be done in one axis or a combination of axes.

Figure 3A:
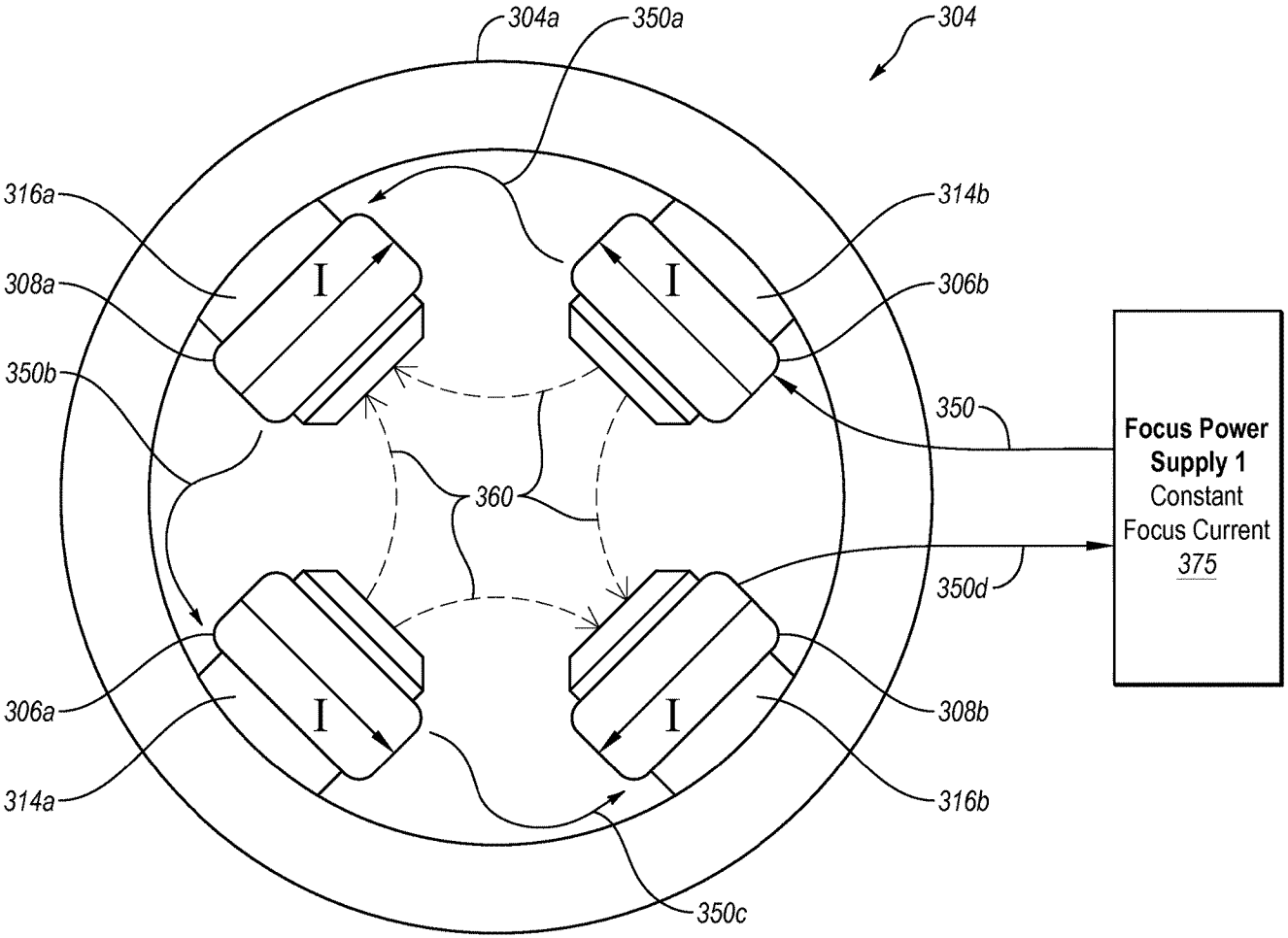
FIGS. 3A-3B are a top views of one embodiment of a magnetic system.
Figure 3B:
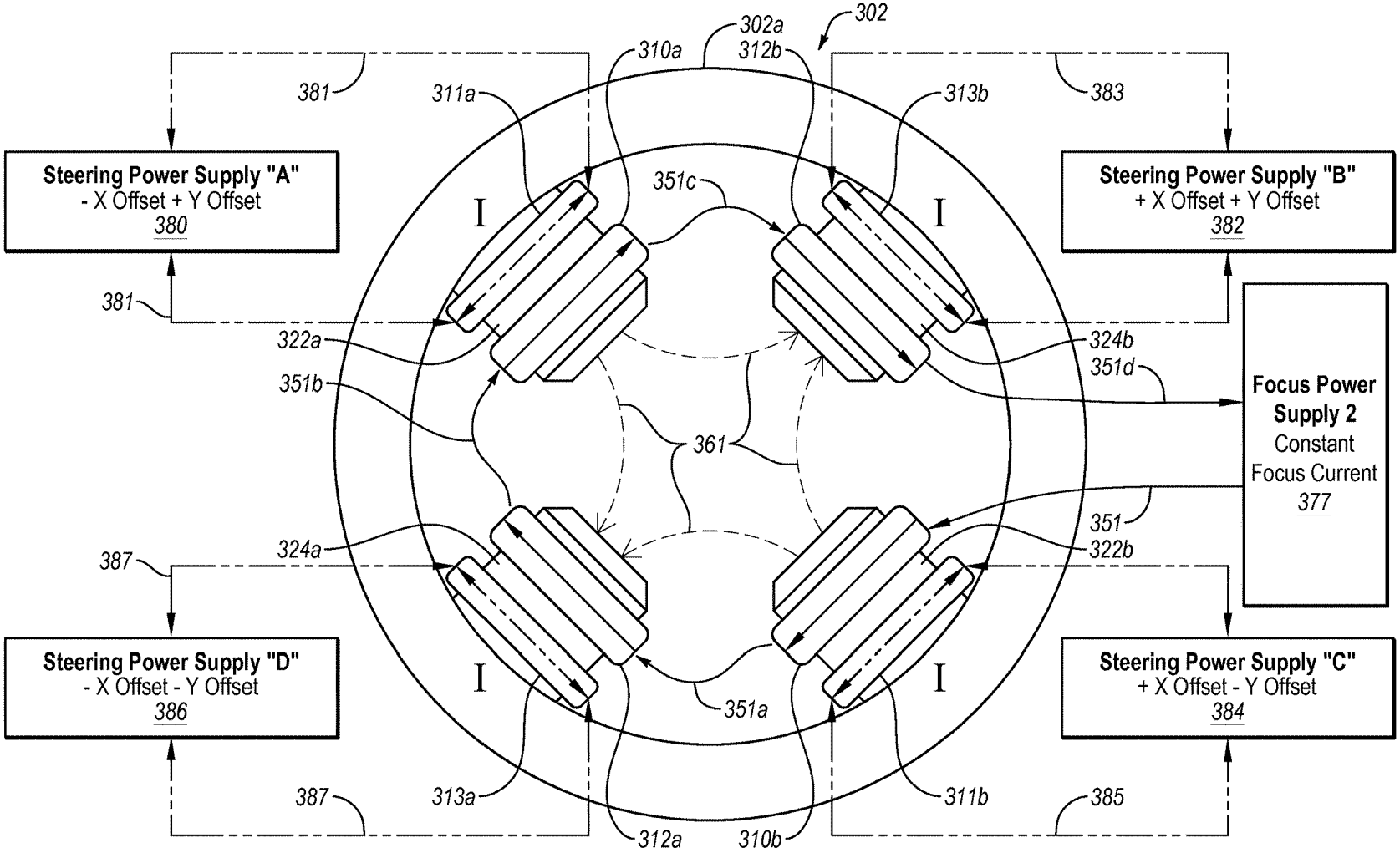

In this context, in conjunction with the embodiments shown in FIGS. 1A-1D and 2A-2B (with reference to the magnetic system 300 in particular), reference is further made to FIGS. 3A and 3B. FIG. 3A shows an embodiment of a cathode core 304 having a cathode yoke 304*a* and is configured as a quadrupole (e.g., cathode-side magnetic quadrupole 304), and FIG. 3B illustrates an embodiment of an anode core 302 having an anode yoke 302*a*, also configured as a quadrupole (e.g., anode-side magnetic quadrupole 302). As previously described in connection to FIGS. 2A-2B, in this example each core section includes a yoke having four pole projections arranged in an evenly distributed and opposing relationship, pole projections 314*a,b* and 316*a,b* on the cathode yoke 304*a*, and pole projections 322*a,b* and 324*a,b* on the anode yoke 302*a*. Each pole projection includes corresponding quadrupole coils, denoted at 306*a,b* and 308*a,b* on the cathode core 304 and 310*a,b* and 312*a,b* on the anode core 302. Additionally, the pole projections 322*a,b* and 324*a,b* on the anode yoke 302*a* include steering coils, denoted at 311*a,b* and 313*a,b*. While illustrated as having a substantially circular shape, it will be appreciated that each of the core (or yoke) portions 302*a*, 304*a* can also be configured with different shapes, such as a square orientation, semi-circular, oval, or other. Also, the location of the quadrupole coils and steering coils on the anode core pole projections can be switched.

The two magnetic cores 302, 304 act as lenses, and may be arranged so that the corresponding quadrupole electromagnets thereof are parallel with respect to each other, and perpendicular to the optical axis defined by the electron beam 112. The cores together deflect the accelerated electrons such that the electron beam 112 is focused in a manner that provides a focal spot with a desired shape and size. Each quadrupole lens creates a magnetic field having a gradient, where the magnetic field intensity differs within the magnetic field. The gradient is such that the magnetic quadrupole field focuses the electron beam in a first direction and defocuses in a second direction that is perpendicular to the first direction. The two quadrupoles can be arranged such that their respective magnetic field gradients are rotated about 90° with respect to each other. As the electron beam traverses the quadrupoles, it is focused to an elongated spot having a length to width ratio of a desired proportion. As such, the magnetic fields of the two quadrupole lenses can have symmetry with respect to the optical axis or with respect to a plane through the optical axis.

In an example embodiment, the cathode core 304 focuses in a length direction, and defocuses in width direction of the focal spot. The electron beam is then focused in width direction and defocused in length direction by the following anode core 302. In combination the two sequentially arranged magnetic quadrupoles ensure a net focusing effect in both directions of the focal spot. However, the focusing and defocusing axes of the two different cores can be switched between the anode core 302 and cathode core 304.

The anode core 302 in one option can be further configured to provide a steering effect that enables a steering of the focal spot in a plane perpendicular to an optical axis correspondent to electron beam 112 of the X-ray tube by having steering coils on the pole projections along with the quadrupole coils.

With continued reference to FIG. 3A, a top view of a cathode core 304 is shown. A circular core or yoke portion, denoted at 304*a* is provided, which includes four pole projections 314*a*, 314*b*, 316*a*, 316*b* that are directed toward the center of the circular yoke 304*a*. In an example implementation, the yoke 304*a* and the pole projections 314*a*, 314*b*, 316*a*, 316*b* are constructed of core iron. Moreover each coil can be comprised of 22 gauge magnet wire at 60 turns; obviously other configurations can be suitable depending on the needs of a particular application.

Figure 6A:
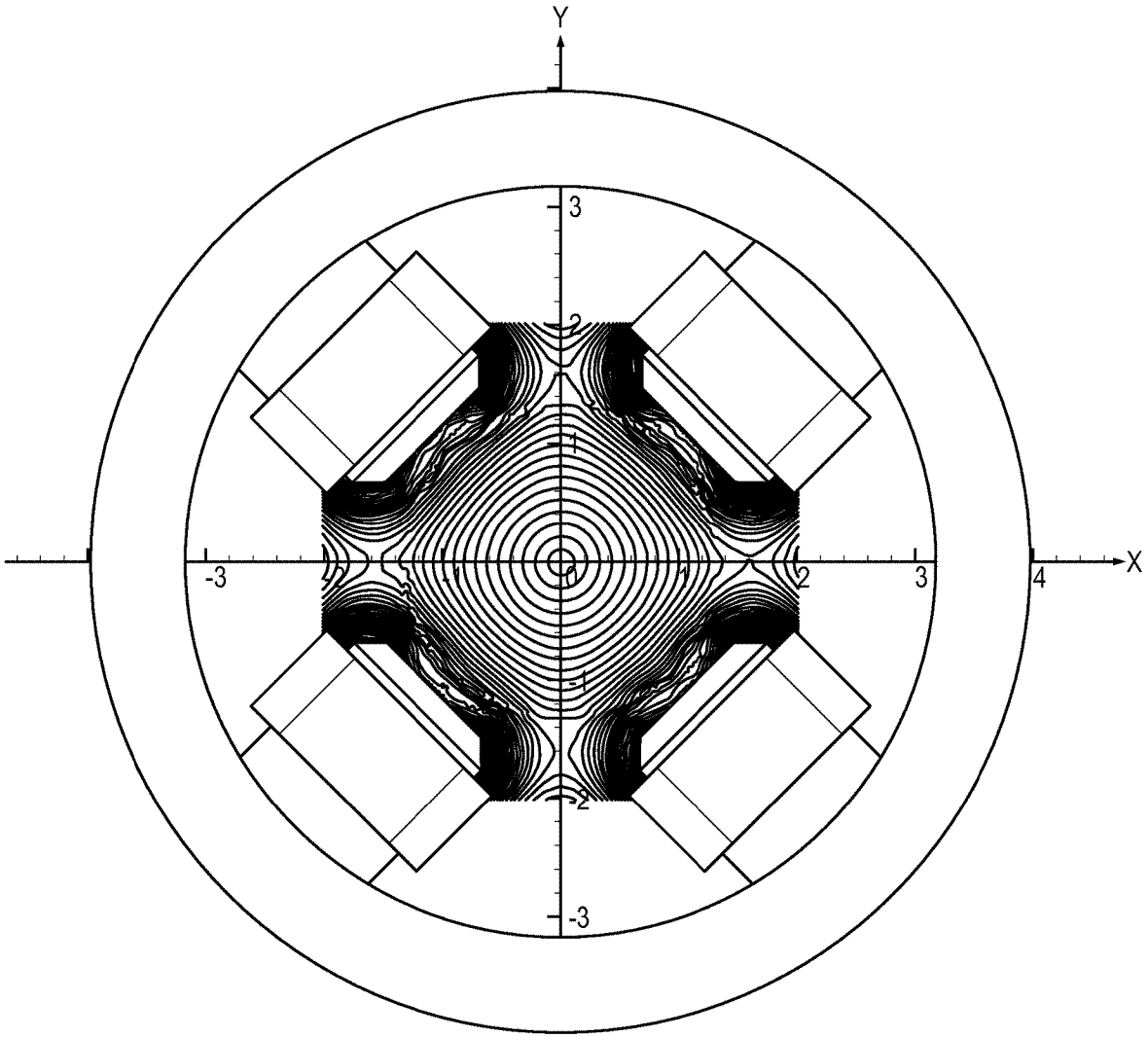
FIGS. 6A-6C are each a schematic diagram showing an example of magnetic fields resulting from quadrupole fields, with FIG. 6A showing a focused quadrupole field that is not shifted.

As is further shown in FIG. 3A, the illustrated example includes a Focus Power Supply 1 375 for providing a predetermined current to the four quadrupole coils, which are connected in electrical series, as denoted schematically at 350, 350*a*, 350*b* 350*c*, and 350*d*. In this embodiment, the current supplied is substantially constant, and results in a current flow within each coil as denoted by the letter 'I' and corresponding arrow, in turn resulting in a magnetic field schematically denoted at 360. The magnitude of the current is selected so as to provide a desired magnetic field that results in a desired focusing effect. See FIG. 6A, which shows an example of a focusing field for a focal spot.

Reference is next made to FIG. 3B, which illustrates an example of a top view of an anode core 302 having a circular core or yoke 302*a*, which includes four pole projections 322*a*, 322*b*, 324*a*, 324*b* also directed toward the center of the circular yoke 302*a*. On each of the pole projections is provided a quadrupole coil, as shown at 310*a*, 310*b*, 312*a* and 312*b*. In addition, a steering coil is collocated on each of the pole projections, as denoted at 311*a*, 311*b* and 313*a*, 313*b*.

The anode core 302 and four pole projections 322*a*, 322*b*, 324*a*, 324*b* can be comprised of a low loss ferrite material so as to better respond to steering frequencies (described herein). The coils can utilize similar gauge magnet wire and similar turn ratio, with variations depending on the needs of a given application. In one option, if steering frequency is sufficiently low, then iron can be used in the steering core instead of ferrite.

As shown in the example embodiment of FIG. 3B, each of the quadrupole coils 310*a*, 310*b*, 312*a* and 312*b* is connected in electrical series to a Focus Power Supply 2 377 for providing a predetermined focus current, as denoted schematically at 351, 351*a*, 351*b*, 351*c*, 351*d*. For purposes of providing a quadrupole magnetic field, a constant 'Focus Current' is provided to each of the quadrupole coils, as already described. Moreover, as denoted by current flow directional arrows at 'I', in turn resulting in a magnetic field schematically denoted at 361. The focus current in the anode core 302 is opposite to the cathode core 304 focus current so as to provide for complimentary magnetic fields, and thereby the focusing effect.

As is further shown in the example embodiment of FIG. 3B, and in contrast with the quadrupole coils, each of the steering coils 311*a,b* and 313*a,b* of the anode quadrupole core 302 includes a separate and independent power source for providing current to induce a magnetic field in a respective steering coil, each power supply being denoted at 380 (Power Supply A), 382 (Power Supply B), 384 (Power Supply C) and 386 (Power Supply D). For purposes of providing a shifted quadrupole field, an AC offset 'Steering Current' is provided to each of the steering coils, as denoted by the schematic electrical circuit associated with each supply (e.g., 381, 383, 385, 387). However, two or more coils may receive zero AC offset.

Figure 6B:
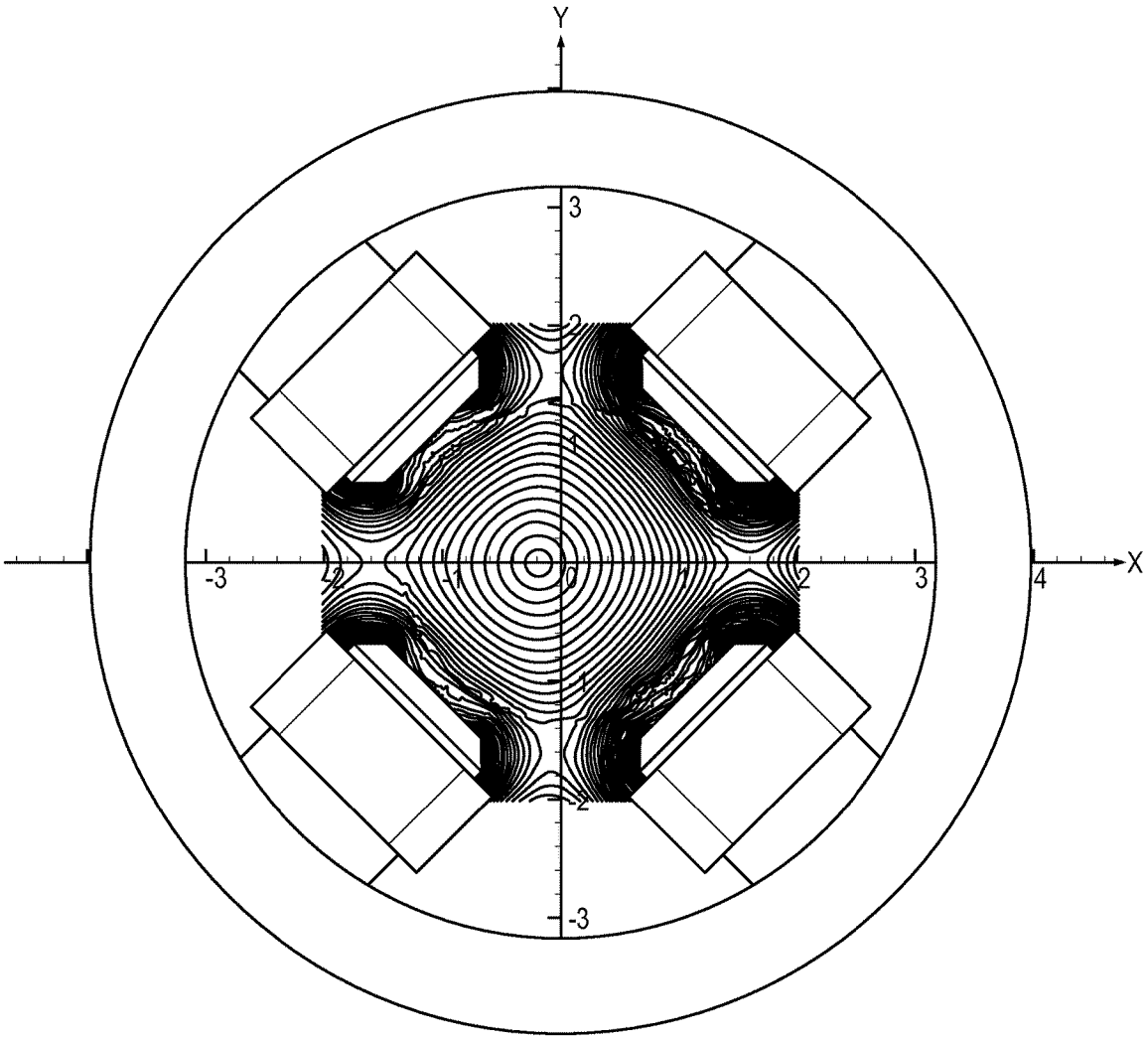
Figure 6C:
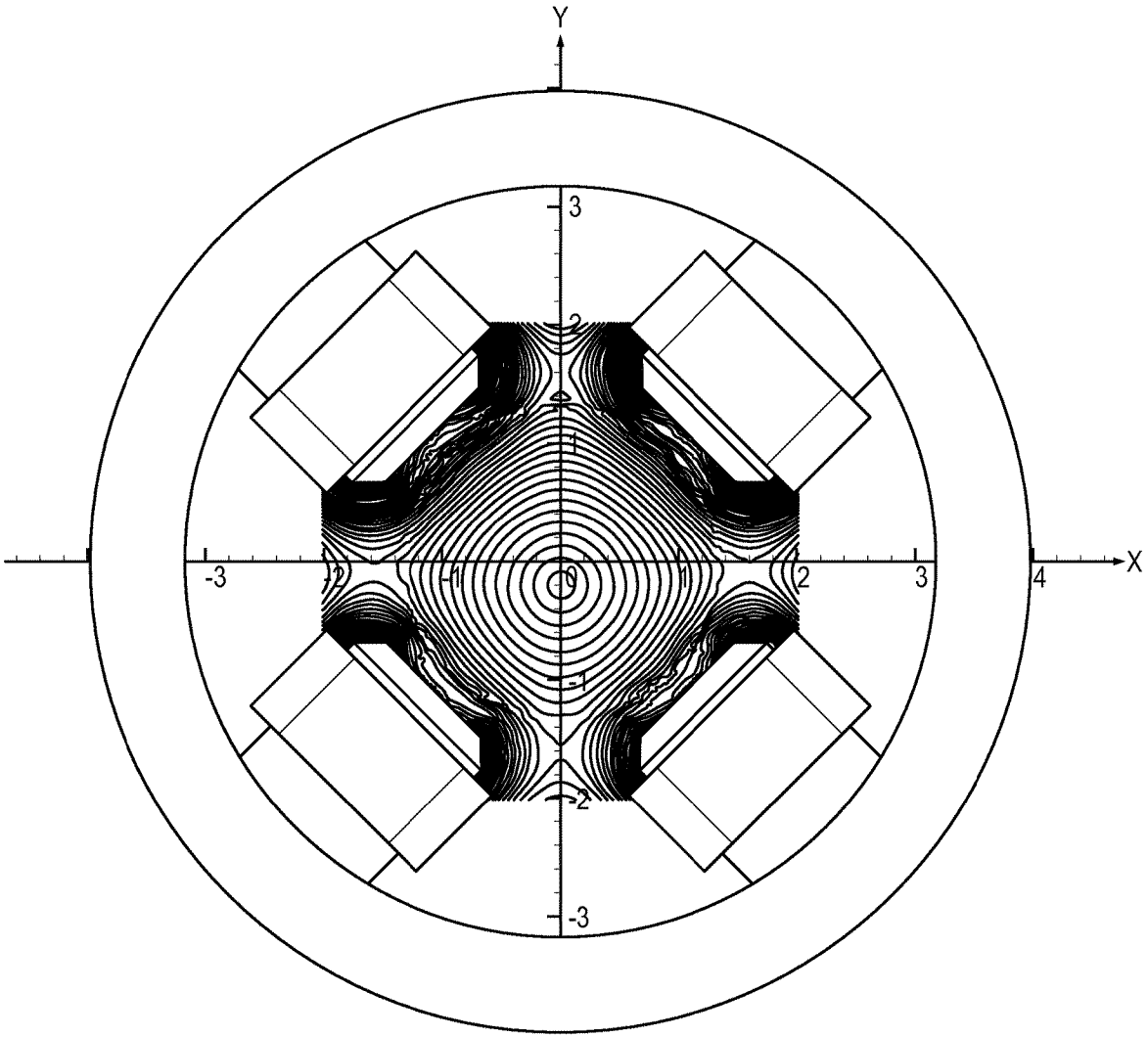

The anode core 302 is further configured to provide a shifted quadrupole effect with the additional steering coils. To do so, each of the activated steering coils is provided with an X offset AC current and a Y offset AC current, where some steering coils can have zero AC offset. The duration of the offset AC currents are at a predetermined frequency and the respective offset current magnitudes are designed to achieve a desired shifted quadrupole field and, in turn, a resultant shift in the electron beam (and focal spot) from a central axis of the cores. Each steering coil is driven independently so that the steering coil pairs have an appropriate current at the desired focal spot steering frequency by application of desired X offset and Y offset alternating currents in corresponding steering coils or steering coil pairs. Quadrupole field perturbations are created in the magnetic field at the desired focal spot steering frequency by application of desired X offset and Y offset alternating currents in corresponding steering coils or steering coil pairs (e.g., opposing steering coils) of the anode core 302. This effectively moves the center of the magnetic field in the 'x' and/or 'y' direction (see, for example, FIGS. 6B and 6C, which show a representative steering effect), which in turn results in a shifting of the electron beam (and resultant position of the focal spot on the anode target) in a prescribed 'x' and/or 'y' direction.

Figure 4:
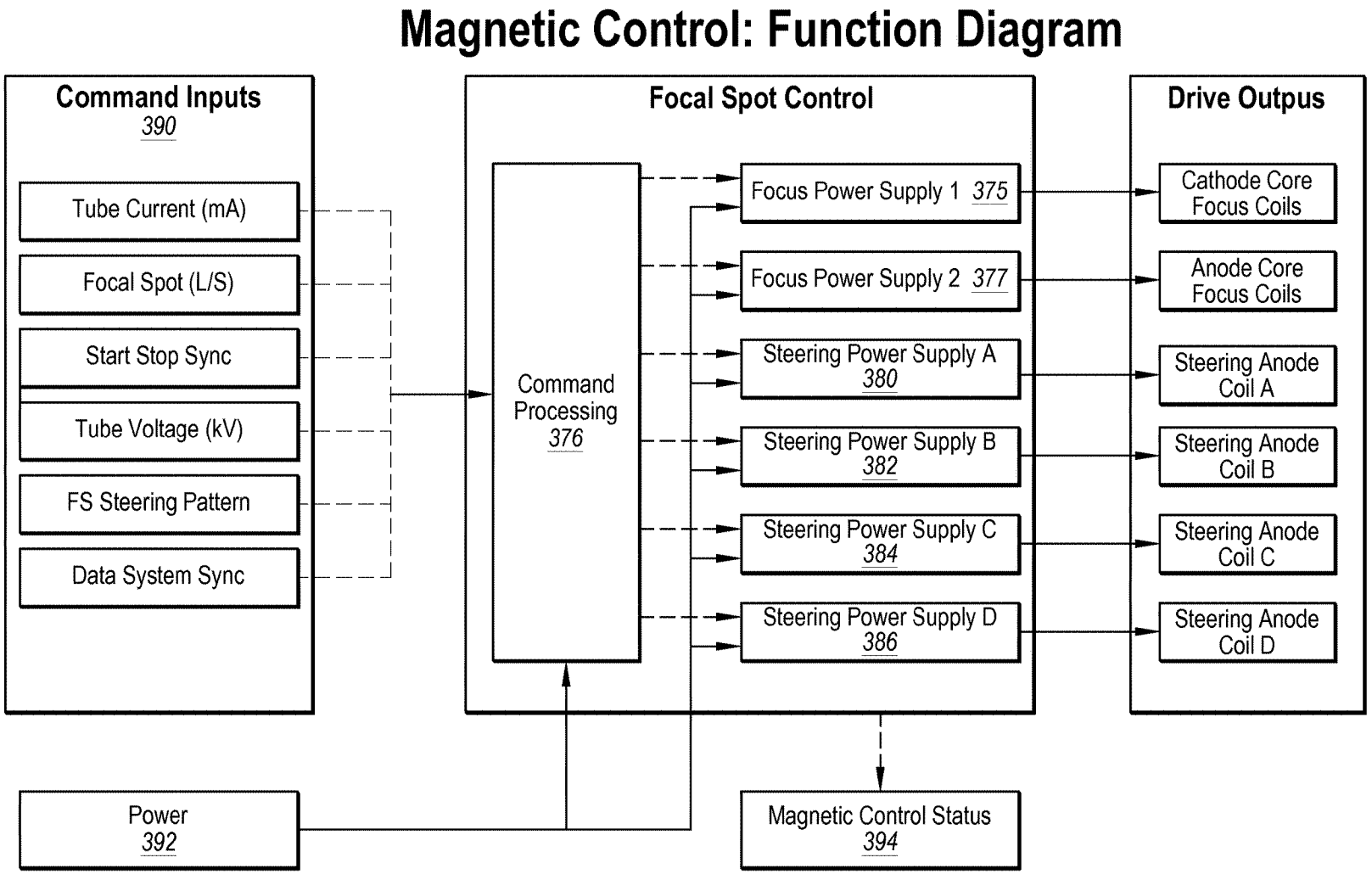
FIG. 4 is a functional block diagram showing one embodiment of a magnetic control for the magnetic system of FIGS. 3A-3B.

Reference is next made to FIG. 4, which illustrates a functional diagram illustrating an embodiment of a magnetic control system for controlling the operation of the magnetic system of FIGS. 3A-3B. At a high level, the magnetic control system of FIG. 4 provides the requisite control of coil currents supplied to the cores 302 and 304 so as to (1) provide a requisite quadrupole field so as to achieve a desired focus of the focal spot; and (2) provide a shift in the quadrupole field so as to achieve a desired position of the focal spot. As noted, control of the steering coil currents is accomplished in a manner so as to achieve a desired steering frequency.

The embodiment of FIG. 4 includes a command processing device 376, which may be implemented with any appropriate programmable device, such as a microprocessor or microcontroller, or equivalent electronics. The command processing device 376 controls, for example, the operation of each of the independent power supplies (i.e., which provide corresponding coils operating current to create a magnetic field), preferably in accordance with parameters stored in non-volatile memory, such as that denoted at Command Inputs 390. For example, in an example operational scheme, parameters stored/defined in Command Inputs 390 might include one or more of the following parameters relevant to the focusing and steering of the focal spot: Tube Current (a numeric value identifying the operational magnitude of the tube current, in milliamps); Focal Spot L/S (such as 'large' or 'small' focal spot size); Start/Stop Sync (identifying when to power on and power off focusing); Tube Voltage (specifying tube operating voltage, in kilovolts); Focal Spot Steering Pattern (for example, a numeric value indicating a predefined steering pattern for the focal spot); and Data System Sync (to sync an X-ray beam pattern with a corresponding imaging system).

In an exemplary implementation, command inputs 390 can correspond to requisite values in a look-up table arrangement. Focus Power Supply 1 375 supplies constant focus current to the quadrupole coils of the cathode core 304 described above. Focus Power Supply 2 377 supplies constant focus current to the coils of the anode core 302 described above. Similarly, Power Supply A (380), Power Supply B (382), Power Supply C (384) and Power Supply D (386) supply AC offset current to the corresponding steering coils for purposes of a steering effect so as to achieve a required electron beam shift (focal spot movement).

Thus, by way of one example, a Focal Spot size specified as 'small' can cause the Command Processing unit 376 to control the Focus Power Supply 1 375 and Focus Power Supply 2 377 to provide a constant focus current (e.g., DC) having the prescribed magnitude (corresponding to a 'small' focal spot) to each of the quadrupole coils of the cathode core 304 and anode core 302. Again, this can result in a quadrupole magnetic field that imposes focusing forces on the electron beam so as to result in a 'small' focal spot on the anode target (see, for example, the magnetic field of FIG. 6A).

Similarly, a FS Steering Pattern might prescribe a specific focal spot steering frequency and requisite displacement in an 'x' and/or 'y' direction. This can result in Command Processing unit 376 to control each of the Power Supplies 380, 382, 384, and 386 to supply a requisite X-offset and Y-offset AC current magnitudes and frequency to the corresponding steering coils of the anode core 302, thereby creating a desired beam steering effect. Also, the X-offset and Y-offset current can be time varying steering current.

In an example embodiment, each of the Power Supplies 375, 377, 380, 382, 384 and 386 are high-speed switching supplies, and which receive electrical power from a main power supply denoted at 392. Magnetic Control Status 394 receives status information pertaining to the operation of the power supplies and the coils, and may be monitored by command processing unit 376 and/or an external monitor control apparatus (not shown).

Thus, in the embodiment of FIGS. 3A-3B and FIG. 4, a magnetic system providing electron beam focusing and two-axis beam steering via two quadrupoles and two pairs of steering coils is provided. While an example embodiment is shown, it will be appreciated that alternate approaches are contemplated. For example, while steering of the electron beam is provided by way of steering coils with the two pair of steering coils formed on the anode core 302, it will be appreciated that both the anode core 302 and the cathode core 304 might be constructed of a ferrite material, and the steering could be "split" between the cores, each having a pair of steering coils (e.g., the pairs are orthogonal) formed thereon to provide a perturbed quadrupole field effect in one direction for example. Other variations would also be contemplated.

Accordingly, the offset can be applied to one coil or two opposing coils. In one example, AC offset is only applied to one coil to get steering in a diagonal direction. In another example, AC offset can be applied to both coils of an opposing coil pair. In one example, one coil of an opposing pair receives AC offset, and the other coil of the opposing pair can be set at zero AC offset. As such one coil can have AC offset in one coil set to zero and the other opposing coil of the pair has an AC offset that is not zero. In one embodiment, the coils of an opposing coil pair can have different offsets. In one embodiment, the AC offset in a pair of opposing coils can be created by having one coil with zero offset while the other has some offset. Application of AC offset to only one coil or having the coils of a coil pair with different AC offset can be applied to all embodiments.

Figure 5:
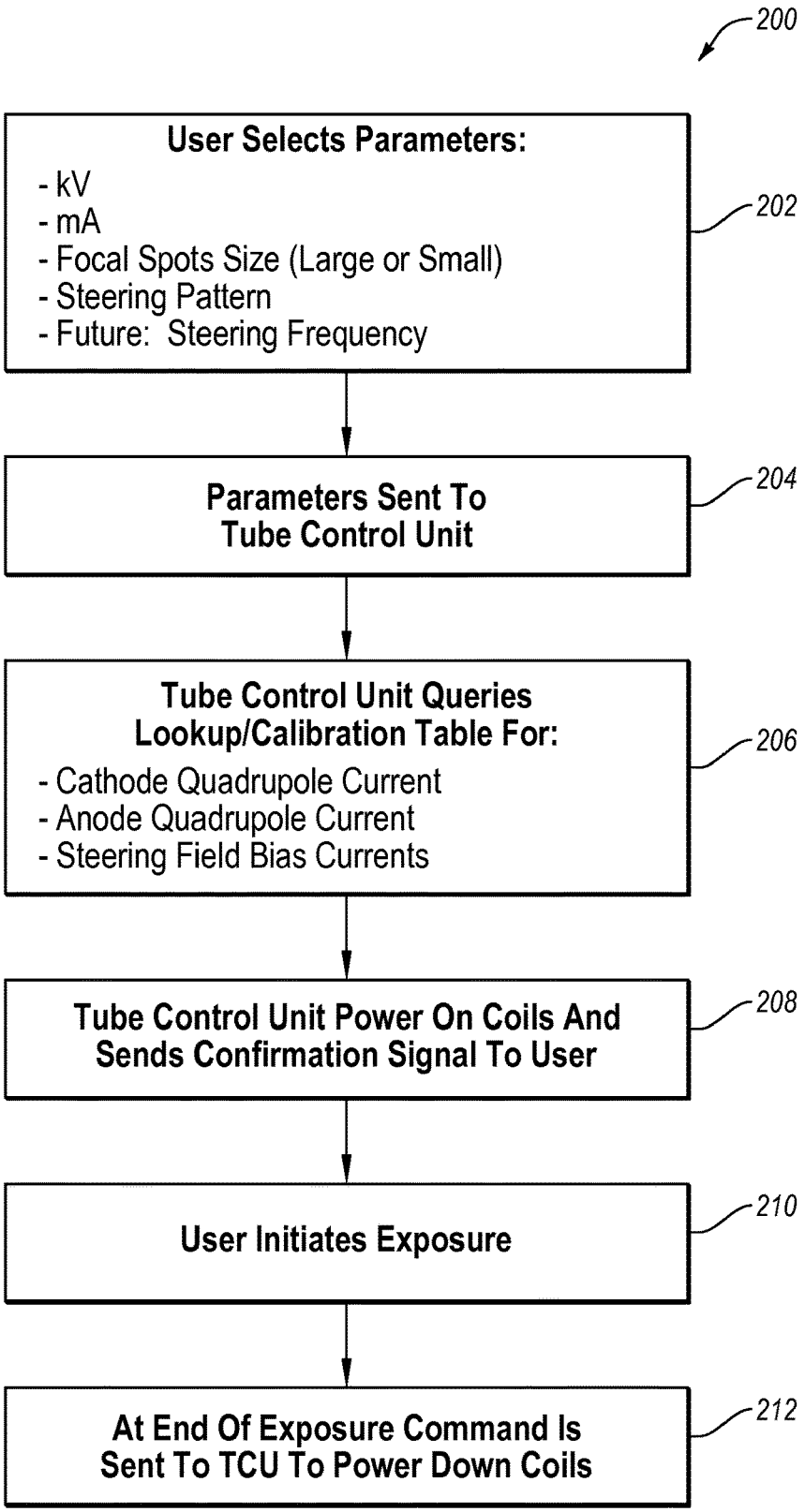
FIG. 5 is a flow chart showing one embodiment of process control for magnetic control.

Reference is next made to FIG. 5, which illustrates one example of a methodology 200 for operating the magnetic control functionality denoted in FIG. 4. Beginning at step 202, a user may select or identify appropriate operating parameters, which are stored as command inputs in memory 390. At step 204, the operating parameters are forwarded to the tube control unit, which includes command processing unit 376. For each operating parameter, at step 206 the command processing unit 376 queries a lookup/calibration table for corresponding values, e.g., cathode quadrupole current, anode quadrupole current and steering field bias currents. At step 208, coils are powered on with respective current values, and confirmation is provided to the user. At step 210, the user initiates the exposure and X-ray imaging commences. At completion, step 212, a command is forwarded which causes power to the coils to be ceased.

Figure 7A:
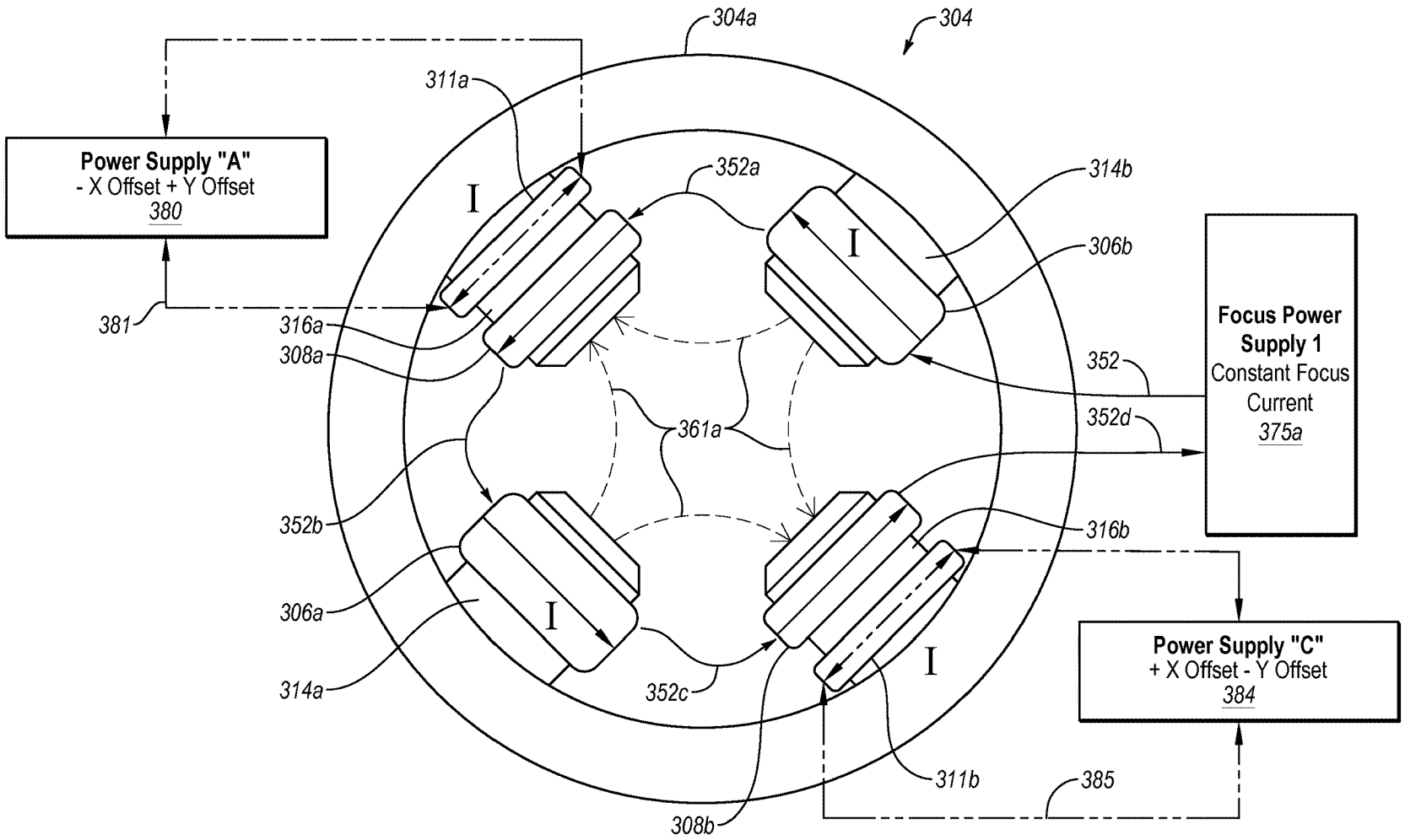
FIGS. 7A-7B are each a top view of one embodiment of a magnet system.
Figure 7B:
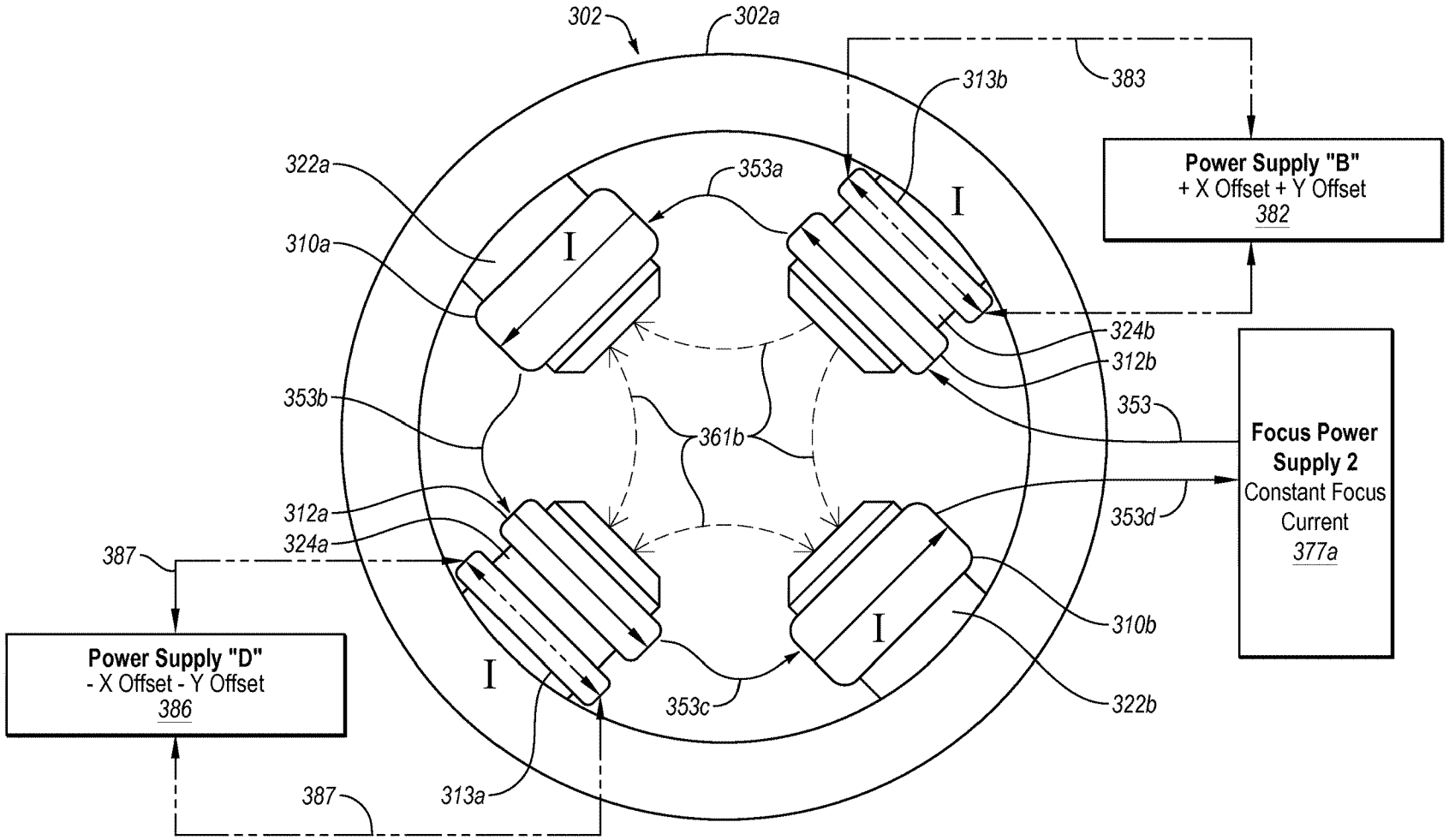

FIG. 7A shows an embodiment of a cathode core 304 having a cathode yoke 304*a* and is configured as a quadrupole (e.g., cathode-side magnetic quadrupole) with a pair of steering coils, and FIG. 7B illustrates an embodiment of an anode core 302 having an anode yoke 302*a*, also configured as a quadrupole (e.g., anode-side magnetic quadrupole) with a pair of steering coils. The subject matter of FIG. 7A can include aspects of FIG. 3A, and the subject matter of FIG. 7B can include aspects of FIG. 3B as described herein.

As is further shown in FIG. 7A, the illustrated example includes a Focus Power Supply 1 375*a* for providing a predetermined constant current to the quadrupole coils (e.g., 306*a*, 306*b*, 308*a*, 308*b*), which are connected in electrical series, as denoted schematically at 352, 352*a*, 352*b*, 352*c*, and 352*d*. The quadrupole coils are operated with constant focus current as described herein. In this embodiment, the current in the quadrupole coil is substantially constant, and results in a current flow within each quadrupole coil as denoted by the letter 'I' and corresponding arrow, in turn resulting in a magnetic field schematically denoted at 361*a*. The magnitude of the current is selected so as to provide a desired magnetic field that results in a desired focusing effect.

Also, the cathode core 304 is further configured to provide a steering effect. Accordingly, two of the pole projections (e.g., 316*a* and 316*b*) have steering coils 311*a* and 311*b* that each include a separate and independent power source for providing current to induce a magnetic field in a respective steering coil, each power supply being denoted at 380 (Power Supply A) and 384 (Power Supply C). To do so, the steering coils 311*a* and 311*b* are provided with an X offset AC current and a Y offset AC current, where one steering coil may have zero AC offset. The duration of the offset AC currents are at a predetermined frequency and the respective offset current magnitudes are designed to achieve a desired perturbed quadrupole field and, in turn, a resultant shift in the electron beam (and focal spot). Thus, steering coils 311*a* and 311*b* are driven independently with perturbations that are created in the magnetic field at the desired focal spot steering frequency by application of desired X offset and Y offset currents as steering pairs of the cathode core 304. This effectively moves the center of the quadrupole magnetic field in the 'x' and/or 'y' direction, which in turn results in a shifting of the electron beam (and resultant position of the focal spot on the anode target) in a prescribed 'x' and/or 'y' direction.

As is further shown in FIG. 7B, the illustrated example includes a Focus Power Supply 377*a* for providing a predetermined constant current in the four quadrupole coils (e.g., 310*a*, 310*b*, 312*a*, 312*b*), which are connected in electrical series, as denoted schematically at 353, 353*a*, 353*b*, 353*c*, and 353*d*. The quadrupole coils are operated with constant focus current as described herein. In this embodiment, the current in the quadrupole coil is substantially constant, and results in a current flow within each quadrupole coil as denoted by the letter 'I' and corresponding arrow, in turn resulting in a magnetic field schematically denoted at 36 lb. The magnitude of the current is selected so as to provide a desired magnetic field that results in a desired focusing effect. The focus current in the anode core 302 is opposite to the cathode core 304 focus current so as to provide for complimentary magnetic fields, and required focusing effect.

Also, the anode core 302 is further configured to provide a steering effect. Accordingly, two of the pole projections (e.g., 324*a* and 324*b*) have steering coils 313*a* and 313*b* that each include a separate and independent power source for providing current to induce a magnetic field in a respective steering coil, each power supply being denoted at 382 (Power Supply B) and 386 (Power Supply D). To do so, the steering coils 313*a* and 313*b* are provided with an X offset current and a Y offset current, where one steering coil can have zero AC offset. The duration of the offset currents are at a predetermined frequency and the respective offset current magnitudes are designed to achieve a desired perturbed quadrupole field and, in turn, a resultant shift in the electron beam (and focal spot). Thus, steering coils 313*a* and 313*b* are driven independently with steering perturbations that are created in the magnetic field at the desired focal spot steering frequency by application of desired X offset and Y offset AC currents as steering coil pairs of the anode core 302. This effectively moves the center of the magnetic field in the 'x' and/or 'y' direction, which in turn results in a shifting of the electron beam (and resultant position of the focal spot on the anode target) in a prescribed 'x' and/or 'y' direction. Thus, the combination of steering coil pairs 311*a,b* and steering coil pairs 313*a,b* provide steering in both the "x" and "y;" directions.

The cores 302, 304 of FIGS. 7A and 7B can be operated the same as described in connection with FIGS. 3A and 3B with FIG. 4. However, with FIGS. 7A and 7B, the focus power supplies are Focus Power Supply 1 375*a* and Focus Power Supply 2 377*a*. Accordingly, having one pair of steering coils on the anode quadrupole core 302 and having one pair of steering coils on the cathode quadrupole core 304 can provide for both cores 302, 304 implementing focusing, and the cathode core 304 implementing steering in a first direction and the anode core 302 implementing steering in a second direction that is perpendicular with the first direction.

In one embodiment, the steering quadrupole core can be operated under high speed switching. Such high speed switching can be at 6.5 to 7 kHz, and may include 20 microsecond transition times. Also, the focusing can have a magnetic flux that is about 400 gauss, whereas the steering can have a magnetic flux of 30-40. However, these values may vary, such as by 1, 2, 5, 10, or 20%.

In one embodiment, an X-ray tube can include: a cathode including an emitter, wherein the emitter has a substantially planar surface configured to emit electrons in an electron beam in a non-homogenous manner; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second orthogonal directions of a focal spot of the electron beam; and at least one steering coil or a pair of steering coils configured to deflect the electron beam in order to shift the focal spot of the electron beam on a target, the one steering coil or pair of steering coils being on the first yoke or the second yoke, or one coil or a pair of steering coils on the first yoke and one coil or a pair of steering coils on the second yoke.

It will be appreciated that various implementations of the electron beam steering, as described herein, can be used advantageously in connection with the tunable emitter, and that features of each are complementary to one another. However, it will also be appreciated that various features—of either electron beam steering or of the planar emitter—do not need to be used together, and have applicability and functionality in separate implementations.

In one embodiment, an X-ray tube can include: a cathode including an electron emitter that emits an electron beam (e.g., substantially laminar beam); an anode configured to receive the electron beam; a first magnetic quadrupole between the cathode and the anode and having a first yoke with four evenly distributed first pole projections extending from the first yoke and oriented toward a central axis of the first yoke and each of the four first pole projections having a first quadrupole electromagnetic coil; a second magnetic quadrupole between the first magnetic quadrupole and the anode and having a second yoke with four evenly distributed second pole projections extending from the second yoke and oriented toward a central axis of the second yoke and each of the four second pole projections having a second quadrupole electromagnetic coil; and one steering coil on a pole projection or a pair of opposing steering coils on a pair of opposing pole projections of the first or second pole projections. In one aspect, the X-ray tube can include two pairs of steering coils formed from two pairs of opposing steering coils on the first and/or second pole projections. In one aspect, the two pair of steering coils are both in a plane formed by one of the first yoke or second yoke. In one aspect, a first pair of steering coils of the two pair of steering coils is in a first plane (e.g., cathode core) and a second pair of steering coils is in a different second plane (e.g., anode core). In one aspect, the first pole projections each have the steering coils so as to form the two pair of steering coils. In one aspect, the second pole projections each have the steering coils so as to form the two pair of steering coils. In one aspect, the two pair of steering coils are orthogonal. In one aspect, one coil of each coil pair can be omitted or have zero AC offset.

In one embodiment, the X-ray tube can include four power supplies, each being operably coupled with a steering coil. In one aspect, the X-ray tube can include a first focus power supply operably coupled with the first quadrupole electromagnetic coils; and/or a second focus power supply operably coupled with the second quadrupole electromagnetic coils.

In one embodiment, the X-ray tube can include: the first magnetic quadrupole being configured for providing a first magnetic quadrupole gradient for focusing the electron beam in a first direction and defocusing the electron beam in a second direction orthogonal to the first direction; the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam. In one aspect, the X-ray tube can include one steering coil, a pair of steering coils, three coils, or two pairs of steering coils being configured to deflect the electron beam in order to shift a focal spot of the electron beam on a target surface of the anode.

In one aspect, the four first pole projections can be at 45, 135, 225, and 315 degrees, and the four second pole projections can be at 45, 135, 225, and 315 degrees.

In one embodiment, the X-ray tube can include the electron emitter, such as any emitter that can emit a substantially laminar beam. For example, the emitter can have a substantially planar surface configured to emit electrons in an electron beam in a non-homogenous manner. In one aspect, the cathode can have a cathode head surface with one or more focusing elements located adjacent to the electron emitter. The emitter can be any electron emitter having a configuration to emit electrons in the electron beam to be substantially laminar. Any emitter that emits a substantially laminar beam (e.g., significantly laminar beam) can be used with the focusing and steering systems described herein.

In one embodiment, the X-ray tube can include the four second pole projections having the four second quadrupole electromagnetic coils adjacent to pole projection ends. Also, the X-ray tube can include the four second pole projections having four steering coils between the four second quadrupole electromagnetic coils and the second yoke.

In one embodiment, an X-ray tube can include: a cathode including an emitter; an anode configured to receive the emitted electrons; a first magnetic quadrupole formed on a first yoke and having a magnetic quadrupole gradient for focusing the electron beam in a first direction and defocusing the electron beam in a second direction perpendicular to the first direction; a second magnetic quadrupole formed on a second yoke and having a magnetic quadrupole gradient for focusing the electron beam in the second direction and defocusing the electron beam in the first direction; wherein a combination of the first and second magnetic quadrupoles provides a net focusing effect in both first and second directions of a focal spot of the electron beam; and at least one of the first yoke or second yoke has two opposing pole projections each with a steering coil that together perturb the quadrupole field so as to deflect the electron beam in order to shift the focal spot of the electron beam on a target of the anode.

In one embodiment, at least one of the first yoke or second yoke has two pairs of opposing pole projections, each pole projection with a steering coil. In one aspect, each pair of two opposing steering coils deflect the electron beam in order to shift the focal spot of the electron beam on a target of the anode. In one aspect, both pair of steering coils are configured on the first yoke or the second yoke, or one pair of steering coils one each of the first yoke and the second yoke.

In one embodiment, a method of focusing and steering an electron beam in an X-ray tube can include: providing an X-ray tube of one of the embodiments (e.g., having at least one pair of steering coils); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; and operating the pair of steering coils so as to steer the electron beam away from the electron beam axis. In one aspect, the method can include operating opposing steering coils of the pair to have different powers to form an asymmetric quadrupole field. In one aspect, the method can include forming a plurality of different focal spots at different locations on the anode for a given time interval, which time interval can be about 0.1, 0.2, 0.25, 0.3, 0.4, 0.5, 0.75, 1, 2, 3, 4, or 5 seconds, and generally less than 30 seconds. In one aspect, the method can include forming a plurality of different focal spots having different focal spot areas for a given time interval, which time interval can be the same or different from above.

In one embodiment, a method of focusing and steering an electron beam in an X-ray tube can include: providing the X-ray tube of one of the embodiments (e.g., having at least two pairs of steering coils); operating the electron emitter so as to emit the electron beam from the cathode to the anode along an electron beam axis; operating the first magnetic quadrupole to focus the electron beam in a first direction; operating the second magnetic quadrupole to focus the electron beam in a second direction orthogonal with the first direction; operating a first pair of steering coils to steer the electron beam away from the electron beam axis in a first direction; and operating a second pair of steering coils to steer the electron beam away from the electron beam axis in a second direction that is orthogonal to the first direction. In one aspect, the method can include operating opposing steering coils of the first pair of steering coils to have different powers to form a first asymmetric quadrupole field. In one aspect, the method can include operating opposing steering coils of the second pair of steering coils to have different powers to form a second asymmetric quadrupole field.

In one embodiment, one or both of the quadrupole cores can be devoid of electromagnetic coils wrapped around the core. The coils are on the pole projections, and the core is devoid of having coils wrapped around the core between the pole projections.

From the foregoing, it will be appreciated that various embodiments of the present disclosure have been described herein for purposes of illustration, and that various modifications may be made without departing from the scope and spirit of the disclosure. Accordingly, the various embodiments disclosed herein are not intended to be limiting, with the true scope and spirit being indicated by the following claims.

The invention claimed is:

1. An X-ray tube comprising:

a cathode including an electron emitter that emits an electron beam;

an anode configured to receive the electron beam;

a first focusing magnetic quadrupole between the cathode and the anode and having a first yoke with four evenly distributed first pole projections extending from the first yoke and oriented toward a central axis of the first yoke and each of the four first pole projections having a first focusing quadrupole electromagnetic coil;

a second focusing magnetic quadrupole between the first focusing magnetic quadrupole and the anode and having a second yoke with four evenly distributed second pole projections extending from the second yoke and oriented toward a central axis of the second yoke and each of the four second pole projections having a second focusing quadrupole electromagnetic coil; and at least four steering coils, each steering coil being collocated with a radially adjacent:

first focusing quadrupole electromagnetic coil on a first pole projection with respect to the central axis of the first yoke; or second focusing quadrupole electromagnetic coil on a second pole projection with respect to the central axis of the second yoke.

2. The X-ray tube of claim 1, comprising a pair of opposing steering coils on a pair of opposing pole projections of the first or second pole projections.

3. The X-ray tube of claim 2, comprising two pairs of steering coils, each pair of steering coils being formed from a pair of opposing first and/or second pole projections.

4. The X-ray tube of claim 3, wherein the two pairs of steering coils are both in a plane formed by one of the first yoke or second yoke.

5. The X-ray tube of claim 3, wherein a first pair of steering coils is in a first plane and a second pair of steering coils is in a different second plane.

6. The X-ray tube of claim 3, wherein the first pole projections each have the two pairs of steering coils so as to form the two pairs of steering coils.

7. The X-ray tube of claim 3, wherein the second pole projections each have the two pairs of steering coils so as to form the two pairs of steering coils.

8. The X-ray tube of claim 3, wherein the two pairs of steering coils are orthogonal.

9. The X-ray tube of claim 3, comprising four power supplies, each being operably coupled with a steering coil.

10. The X-ray tube of claim 3, comprising:

a first focus power supply operably coupled with the first quadrupole electromagnetic coils; and/or a second focus power supply operably coupled with the second quadrupole electromagnetic coils.

11. The X-ray tube of claim 3, comprising:

the first magnetic quadrupole being configured for providing a first magnetic quadrupole gradient for focusing the electron beam in a first direction and defocusing the electron beam in a second direction orthogonal to the first direction;

the second magnetic quadrupole being configured for providing a second magnetic quadrupole gradient for focusing the electron beam in the second direction and defocusing the electron beam in the first direction; and wherein a combination of the first and second magnetic quadrupoles provides a net focusing effect in both first and second directions of a focal spot of the electron beam, and the two pairs of steering coils being configured to deflect the electron beam in order to shift a focal spot of the electron beam on a target surface of the anode.

12. The X-ray tube of claim 3, comprising:

the four second pole projections having the four second quadrupole electromagnetic coils adjacent to pole projection ends and having four steering coils between the four second quadrupole electromagnetic coils and the second yoke.

13. A method of focusing and steering an electron beam in an X-ray tube, the method comprising:

providing the X-ray tube of claim 2;

operating the electron emitter so as to emit the electron beam from the cathode to the anode along an electron beam axis;

operating the first focusing magnetic quadrupole to focus the electron beam in a first direction;

operating the second focusing magnetic quadrupole to focus the electron beam in a second direction orthogonal with the first direction;

operating at least one steering coil of a first pair of steering coils to steer the electron beam away from the electron beam axis in a first direction; and operating at least one steering coil of a second pair of steering coils to steer the electron beam away from the electron beam axis in a second direction that is orthogonal to the first direction.

14. The method of claim 13, comprising:

operating opposing steering coils of the first pair of steering coils to have different currents to form a first asymmetric quadrupole field; and operating opposing steering coils of the second pair of steering coils to have different currents to form a second asymmetric quadrupole field.

15. The X-ray tube of claim 1, comprising:

the four first pole projections being at 45, 135, 225, and 315 degrees; and the four second pole projections being at 45, 135, 225, and 315 degrees.

16. The X-ray tube of claim 1, comprising the electron emitter having a flat emission surface to emit electrons in the electron beam to be a substantially laminar beam.

17. A method of focusing and steering an electron beam in an X-ray tube, the method comprising:

providing the X-ray tube of claim 1;

operating the electron emitter so as to emit the electron beam from the cathode to the anode along an electron beam axis;

operating the first focusing magnetic quadrupole to focus the electron beam in a first direction;

operating the second focusing magnetic quadrupole to focus the electron beam in a second direction orthogonal with the first direction; and operating at least one steering coil to steer the electron beam away from the electron beam axis.

18. The method of claim 17, comprising operating opposing steering coils of a steering coil pair to have different currents to form an asymmetric quadrupole field.

19. The method of claim 17, comprising forming a plurality of different focal spots at different locations on the anode for a given time interval.

20. The method of claim 19, wherein the time interval is 5 seconds or less.

21. The method of claim 17, comprising forming a plurality of different focal spots having different focal spot areas for a given time interval.

22. The method of claim 21, wherein the time interval is 5 seconds or less.

23. The X-ray tube of claim 1, further comprising a gap between each steering coil and collocated first or second quadrupole electromagnetic coil.

24. An X-ray tube comprising:

a cathode including an emitter that emits an electron beam;

an anode configured to receive the electron beam;

a first focusing magnetic quadrupole formed on a first yoke and having a magnetic quadrupole gradient for focusing the electron beam in a first direction and defocusing the electron beam in a second direction perpendicular to the first direction;

a second focusing magnetic quadrupole formed on a second yoke and having a magnetic quadrupole gradient for focusing the electron beam in the second direction and defocusing the electron beam in the first direction;

wherein a combination of the first and second focusing magnetic quadrupoles provides a net focusing effect in both first and second directions of a focal spot of the electron beam; and at least one of the first yoke or second yoke having two opposing pole projections each with a steering coil that together form a pair of steering coils configured to deflect the electron beam in order to shift the focal spot of the electron beam on a target of the anode, each steering coil being collocated with a radially adjacent:

focusing quadrupole electromagnetic coil on a first pole projection with respect to a central axis of the first yoke; or focusing quadrupole electromagnetic coil on a second pole projection with respect to a central axis of the second yoke.

25. The X-ray tube of claim 24, at least one of the first yoke or second yoke having two pairs of opposing pole projections, each pole projection with a steering coil, wherein each pair of two opposing steering coils to-deflects the electron beam in order to shift the focal spot of the electron beam on a target of the anode.

26. The X-ray tube of claim 25, wherein both pairs of steering coils are configured on the first yoke or the second yoke, or one pair of steering coils on each of the first yoke and the second yoke.

* * * * *